US005586532A

United States Patent [19]

Faletti et al.

[11] Patent Number: 5,586,532

[45] Date of Patent: Dec. 24, 1996

[54] RECIRCULATION OF ACTUATING FLUID IN AN ENGINE BRAKING SYSTEM

[75] Inventors: James J. Faletti, Spring Valley; Dennis D. Feucht; Scott G. Sinn, both of Morton, all of Ill.

[73] Assignee: Caterpillar Inc., Peoria, Ill.

[21] Appl. No.: 550,047

[22] Filed: Oct. 30, 1995

Related U.S. Application Data

[62] Division of Ser. No. 468,937, Jun. 6, 1995, Pat. No. 5,540,201, which is a continuation of Ser. No. 282,573, Jul. 29, 1994, abandoned.

[51] Int. Cl.[6] ..... F02D 13/04

[52] U.S. Cl. ..... 123/321

[58] Field of Search ..... 123/90.12, 90.13, 123/321, 322

[56] References Cited

U.S. PATENT DOCUMENTS

| | | | |
|---|---|---|---|
| 3,220,392 | 11/1965 | Cummins | 123/321 |
| 4,399,787 | 8/1983 | Cavanagh | 123/321 |
| 4,572,114 | 2/1986 | Sickler | 123/21 |
| 4,592,319 | 6/1986 | Meistrick | 123/321 |
| 4,706,624 | 11/1987 | Meistrick et al. | 123/321 |
| 4,741,307 | 5/1988 | Meneely | 123/321 |
| 4,765,288 | 8/1988 | Linder et al. | 123/90.16 |
| 4,793,307 | 12/1988 | Quenneville et al. | 123/323 |
| 4,974,495 | 12/1990 | Richeson, Jr. | 91/459 |
| 5,012,778 | 5/1991 | Pitzi | 123/321 |
| 5,022,358 | 6/1991 | Richeson | 123/90.12 |
| 5,036,810 | 8/1991 | Meneely | 123/321 |
| 5,125,371 | 6/1992 | Erickson et al. | 123/90.12 |
| 5,255,650 | 10/1993 | Faletti et al. | 123/322 |

FOREIGN PATENT DOCUMENTS

91/03630 3/1991 WIPO .

*Primary Examiner*—Tony M. Argenbright
*Attorney, Agent, or Firm*—Marshall O'Toole Gerstein Murray & Borun

[57] ABSTRACT

An engine brake system for opening an engine exhaust valve recirculates actuating fluid between an actuator and a pump so that demands placed on an oil pump of the engine are minimized.

19 Claims, 23 Drawing Sheets

Fig. 4A
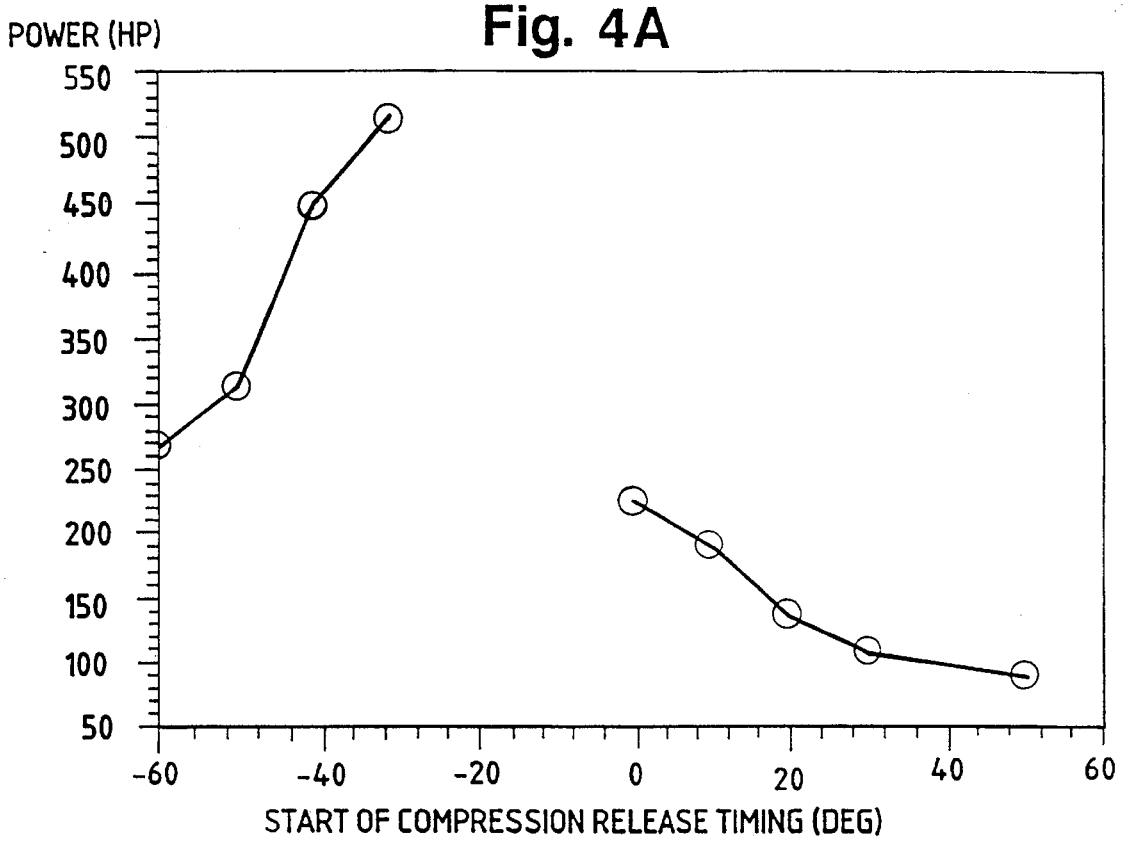
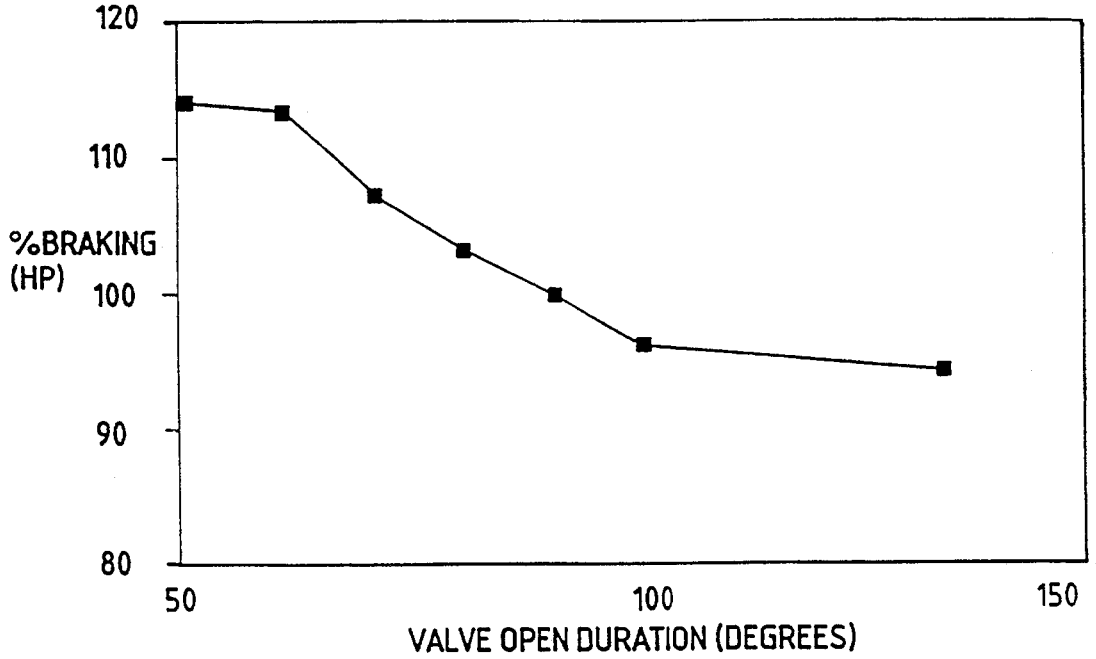
Fig. 4B

CLUTCH SW
383a
THROTTLE POSITION
383b
ENGINE SPEED
383c
SERVICE BRK SW
383d
CRUISE ON/OFF SW
383e
BRK ON/OFF SW
383f
SELECT SWITCH
383
330
BRAKING ?
345
72
OTHER INPUTS
384
INJECTOR CONTROL MODULE
TO LINES 340a-340f
NO
YES
340g
340h
342
HIGH WINS
361
344
340a
340b
340c
340d
340e
340f
340i
340j
341
TO DRIVERS 302a-302f AND CURRENT CONTROL CIRCUITS 308-310 AND SOL. DRV. 312
334
346
348
360
CYL. SEL.
350
d/dt
352
332
356
358
354
338
336
MAP
370
DEG. ON
DEG. OFF
368
BOOST CONTROL MODULE
362
365
364
366
TURBOCHARGER

RECIRCULATION OF ACTUATING FLUID IN AN ENGINE BRAKING SYSTEM

CROSS-REFERENCE TO RELATED APPLICATIONS

This application is a Divisional of application Ser. No. 08/468,937, filed on Jun. 6, 1995, now Pat. No. 5,540,201, that is in turn a Continuation of application Ser. No. 08/282,573 filed on Jul. 29, 1994, now abandoned.

TECHNICAL FIELD

The present invention relates generally to engine retarding systems and methods and, more particularly, to an apparatus and method for engine compression braking.

BACKGROUND ART

Engine brakes or retarders are used to assist and supplement wheel brakes in slowing heavy vehicles, such as tractor-trailers. Engine brakes are desirable because they help alleviate wheel brake overheating. As vehicle design and technology have advanced, the hauling capacity of tractor-trailers has increased, while at the same time rolling resistance and wind resistance have decreased. Thus, there is a need for advanced engine braking systems in today's heavy vehicles.

Problems with existing engine braking systems include high noise levels and a lack of smooth operation at some braking levels resulting from the use of less than all of the engine cylinders in a compression braking scheme. Also, existing systems are not readily adaptable to differing road and vehicle conditions. Still further, existing systems are complex and expensive.

Known engine compression brakes convert an internal combustion engine from a power generating unit into a power consuming air compressor.

U.S. Pat. No. 3,220,392 issued to Cummins on Nov. 30, 1965, discloses an engine braking system in which an exhaust valve located in a cylinder is opened when the piston in the cylinder nears the top dead center (TDC) position on the compression stroke. An actuator includes a master piston, driven by a cam and pushrod, which in turn drives a slave piston to open the exhaust valve during engine braking. The braking that can be accomplished by the Cummins device is limited because the timing and duration of the opening of the exhaust valve is dictated by the geometry of the cam which drives the master piston and hence these parameters cannot be independently controlled.

In conjunction with the increasingly widespread use of electronic controls in engine systems, braking systems have been developed which are electronically controlled by a central engine control unit which optimizes the performance of the braking system. Examples of such systems are disclosed in U.S. Pat. No. 5,012,778 issued to Pitzi on May 7, 1991, U.S. Pat. No. 5,255,650 issued to Faletti et al. on Oct. 26, 1993 (assigned to the assignee of the present application), and U.S. Pat. No. 4,572,114 issued to Sickler on Feb. 25, 1986.

A number of patents disclose the concept of interconnecting a fluid pump with a fluid utilization device in a manner which forms a closed-loop system. Examples of such arrangements in an engine braking system environment are disclosed in U.S. Pat. No. 4,399,787 issued to Cavanagh on Aug. 23, 1983, U.S. Pat. No. 4,592,319 issued to Meistrick on Jun. 3, 1996, U.S. Pat. No. 4,741,307 issued to Meneely on May 3, 1988, and U.S. Pat. No. 4,793,307 issued to Quenneville et al. on Dec. 27, 1988. Examples of such arrangements for use with engine valves generally are disclosed in U.S. Pat. No. 4,765,288 issued to Linder et al. on Aug. 23, 1988 and International Application Publication No. WO 91/03630 published on Mar. 21, 1991.

DISCLOSURE OF THE INVENTION

In accordance with one aspect of the present invention, an engine brake system for opening an engine exhaust valve includes an actuator and a pump. The actuator includes a slave piston having a longitudinal bore therethrough and a further bore extending from the longitudinal bore to a recess on one side of the slave piston. The actuator further includes a valve spool disposed in the bore and having a high pressure annulus and a low pressure annulus spaced from the high pressure annulus wherein the valve spool is movable relative to the slave piston to cause the further bore to be placed in fluid communication with the high pressure annulus or the low pressure annulus. Also, the actuator includes a high pressure inlet coupled to the high pressure annulus and a low pressure outlet coupled to the low pressure annulus. The pump includes a pump inlet coupled to the low pressure outlet and a pump outlet coupled to the high pressure inlet to form a closed-loop system with the actuator.

Preferably, the actuator further includes a further recess on another side of the piston in fluid communication with the low pressure outlet. Also preferably, the actuator includes a control valve coupled between the pump outlet and an end of the valve spool. In accordance with a preferred embodiment, the control valve is operable by a solenoid.

Still further, the actuator may include a first spring on the one side of the slave piston and a second spring on another side of the slave piston. Also, the pump may include a pump piston driven by an engine rocker arm.

Still further in accordance with a preferred embodiment, the actuator and pump are disposed in a single member and the pump outlet may be coupled to the high pressure inlet by a high pressure manifold. First and second check valves may interconnect the actuator and the pump.

In accordance with another aspect of the present invention, an engine brake system for opening an engine exhaust valve includes an actuator and a pump driven by a fuel injector rocker arm. The actuator includes a slave piston disposed in an actuator receiving bore, a valve spool disposed in a central bore of the slave piston and means for resiliently interconnecting the valve spool and the slave piston. The valve spool includes a high pressure annulus and a low pressure annulus and the slave piston includes a passage which is positionable by relative movement between the valve spool and the slave piston into fluid communication with the either the high pressure annulus or the low pressure annulus. The actuator further includes a solenoid-operated control valve having a high pressure inlet, a low pressure inlet coupled to sump and an outlet in fluid communication with the valve spool. Still further, the actuator includes a high pressure rail in fluid communication with the high pressure annulus and coupled to the high pressure inlet of the control valve and an actuator outlet in fluid communication with the low pressure annulus. The pump includes a pump inlet coupled to the actuator outlet and a pump outlet coupled to the high pressure rail.

In accordance with yet another aspect of the present invention, a method of opening an engine exhaust valve using an actuator and a pump includes the steps of interconnecting a low pressure outlet of the actuator with an inlet of the pump and operating the pump to provide high pressure fluid to a high pressure inlet of the actuator. A control valve of the actuator is operated to pass high pressure fluid from the high pressure inlet of the actuator into an actuator receiving bore so that a valve spool and slave piston of the actuator are displaced and open the exhaust valve and so that fluid is expelled from the actuator low pressure outlet and is delivered to the pump inlet.

Other features and advantages are inherent in the apparatus claimed and disclosed or will become apparent to those skilled in the art from the following detailed description in conjunction with the accompanying drawings.

BRIEF DESCRIPTION OF THE DRAWINGS

FIG. 4A comprises a graph illustrating braking power as a function of compression release timing of an engine;

FIG. 4B comprises a graph illustrating percent braking horsepower as a function of valve open duration;

BEST MODE FOR CARRYING OUT THE INVENTION

Figure 1:
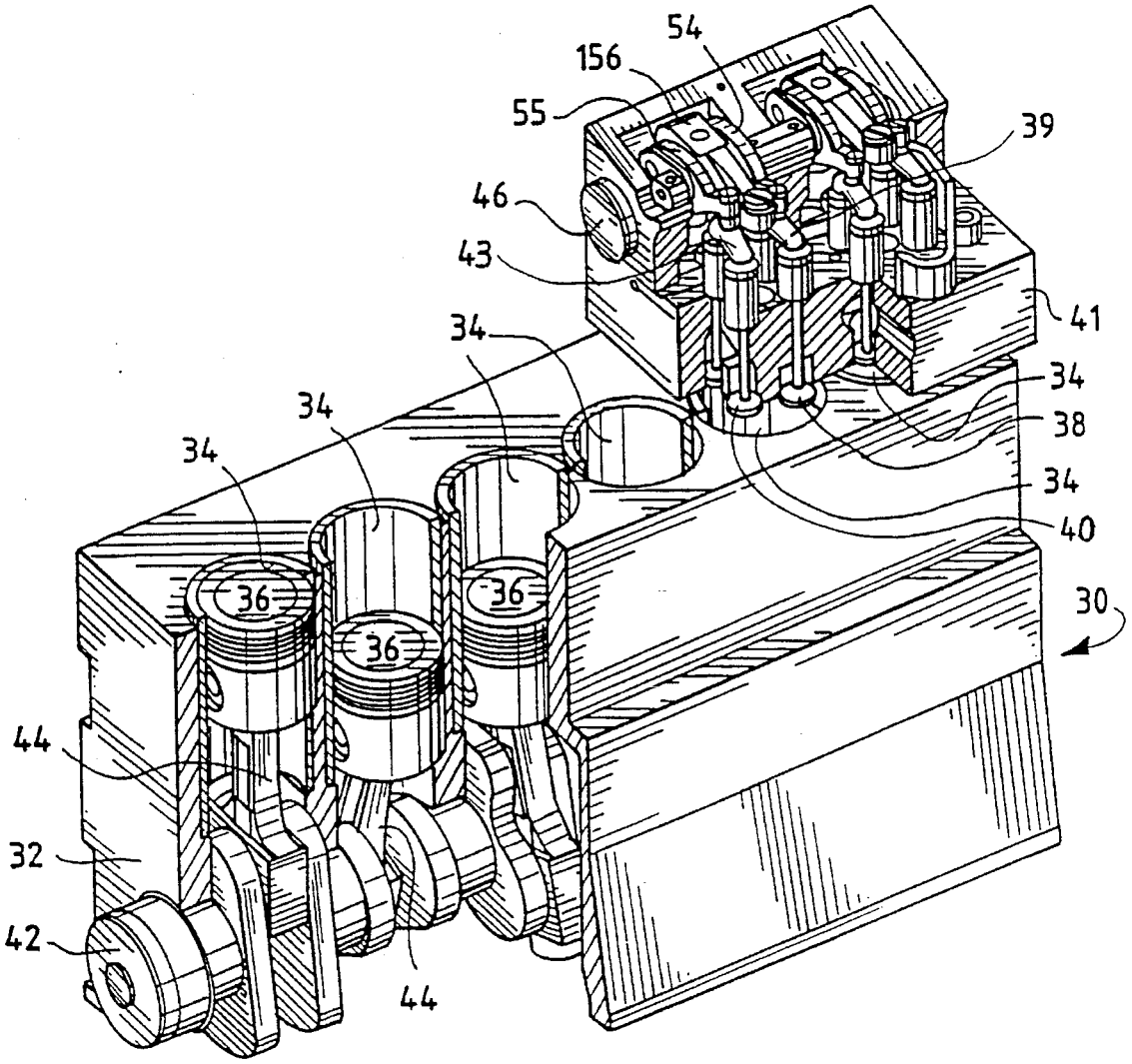
FIG. 1 is a fragmentary isometric view of an internal combustion engine with portions removed to reveal detail therein and with which the braking control of the present invention may be used.

Referring now to FIG. 1, an internal combustion engine 30, which may be of the four-cycle, compression ignition type, undergoes a series of engine events during operation thereof. In the preferred embodiment, the engine sequentially and repetitively undergoes intake, compression, combustion and exhaust cycles during operation. The engine 30 includes a block 32 within which is formed a plurality opened during the compression stroke. This relationship is illustrated by the graph of FIG. 4A.

As seen in FIG. 4B, the duration of time the exhaust valves are maintained in an open state also has an effect upon the maximum braking horsepower which can be achieved.

Figure 5:
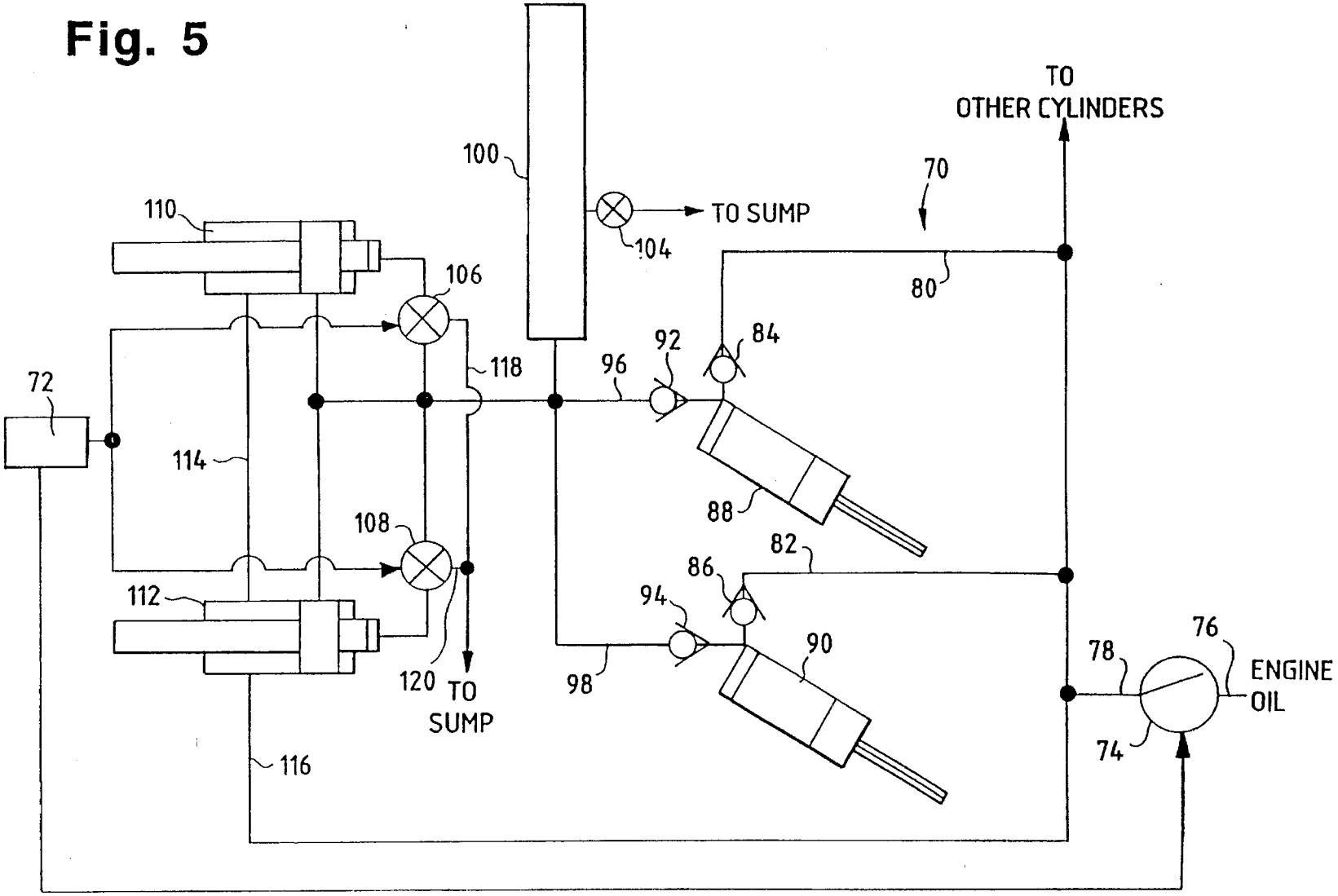
FIG. 5 comprises a combined block and schematic diagram of a braking control according to the present invention.

With reference now to FIG. 5, a two-cylinder portion 70 of a brake control according to the present invention is illustrated. The portion 70 of the brake control illustrated in FIG. 5 is operated by an electronic control module (ECM) 72 to open the exhaust valves 40 of two cylinders 34 with a selectable timing and duration of exhaust valve opening. For a six cylinder engine, up to three of the portions 70 in FIG. 5 could be connected to the ECM 72 so that engine braking is accomplished on a cylinder-by-cylinder basis. Alternatively, fewer than three portions 70 could be used and/or operated so that braking is accomplished by less than all of the cylinders and pistons. Also, it should be noted that the portion 70 can be modified to operate any other number of exhaust valves for any other number of cylinders, as desired. The ECM 72 operates a solenoid control valve 74 to couple a conduit 76 to a conduit 78. The conduit 76 receives engine oil at supply pressure, and hence operating the solenoid control valve 74 permits engine oil to be delivered to conduits 80, 82 which are in fluid communication with check valves 84, 86, respectively. The engine oil under pressure causes pistons of a pair of reciprocating pumps 88, 90 to extend and contact drive sockets of injector rocker arms (described and shown below). The rocker arms cause the pistons to reciprocate and cause oil to be supplied under pressure through check valves, 92, 94 and conduits 96, 98 to an accumulator 100. As such of combustion chambers or cylinders 34, each of which includes an associated piston 36 therein. Intake valves 38 and exhaust valves 40 are carried in a head 41 bolted to the block 32 and operated to control the admittance and expulsion of fuel and gases into and out of each cylinder 34. A crankshaft 42 is coupled to and rotated by the pistons 36 via connecting rods 44 and a camshaft 46 is coupled to and rotates with the crankshaft 42 in synchronism therewith. The camshaft 46 includes a plurality of cam lobes 48 (one of which is visible in FIG. 2) which are contacted by cam followers 50 (FIG. 2) carried by rocker arms 54, 55 which in turn bear against intake and exhaust valves 38, 40, respectively.

Figure 2:
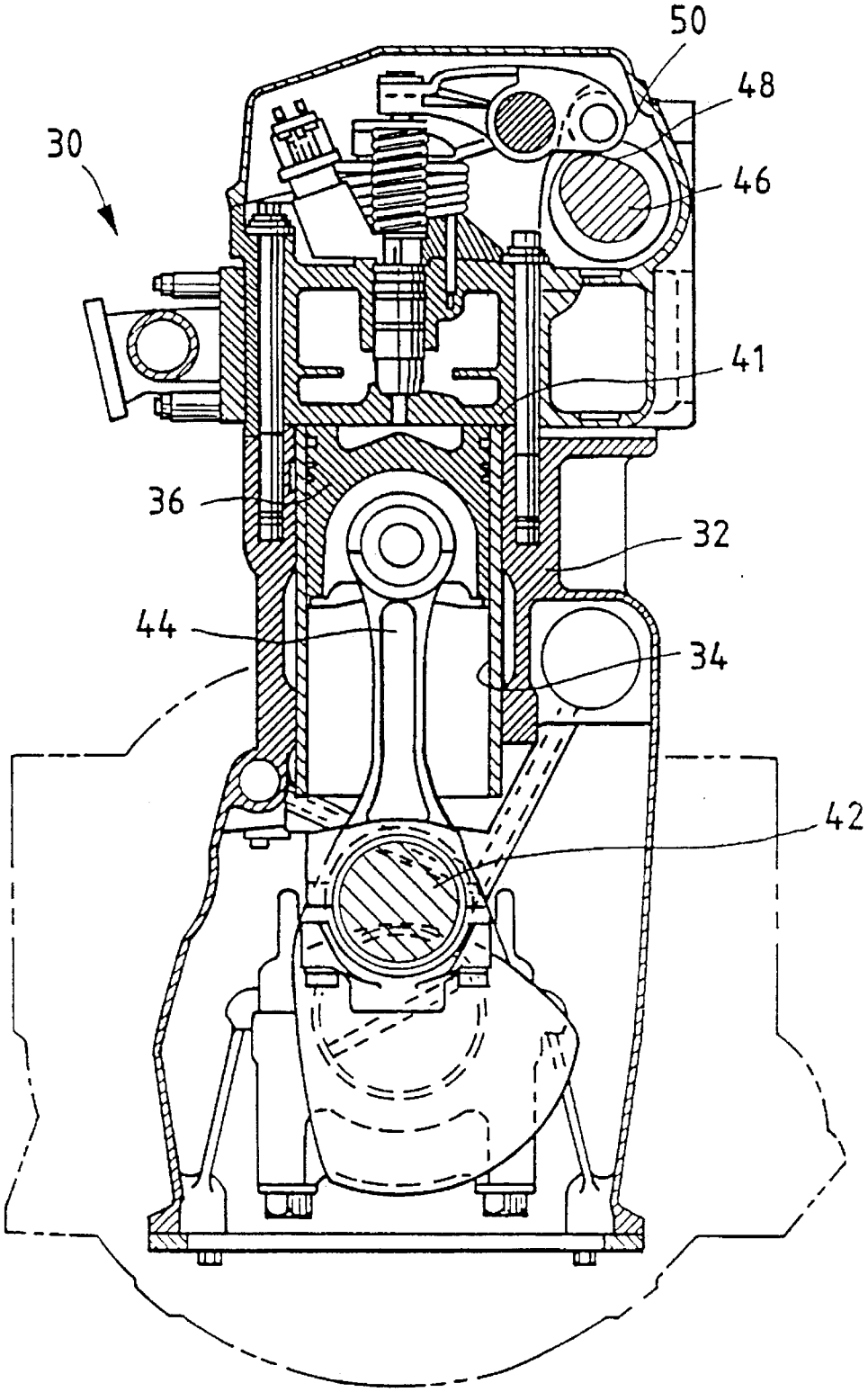
FIG. 2 comprises a sectional view of the engine of FIG. 1.

In the engine 30 shown in FIGS. 1 and 2, there is a pair of intake valves 38 and a pair of exhaust valves 40 per cylinder 34 wherein the valve 38 or 40 of each pair is interconnected by a valve bridge 39, 43, respectively. Each cylinder 34 may instead have a different number of associated intake and exhaust valves 38, 40, as necessary or desirable.

Figure 3:
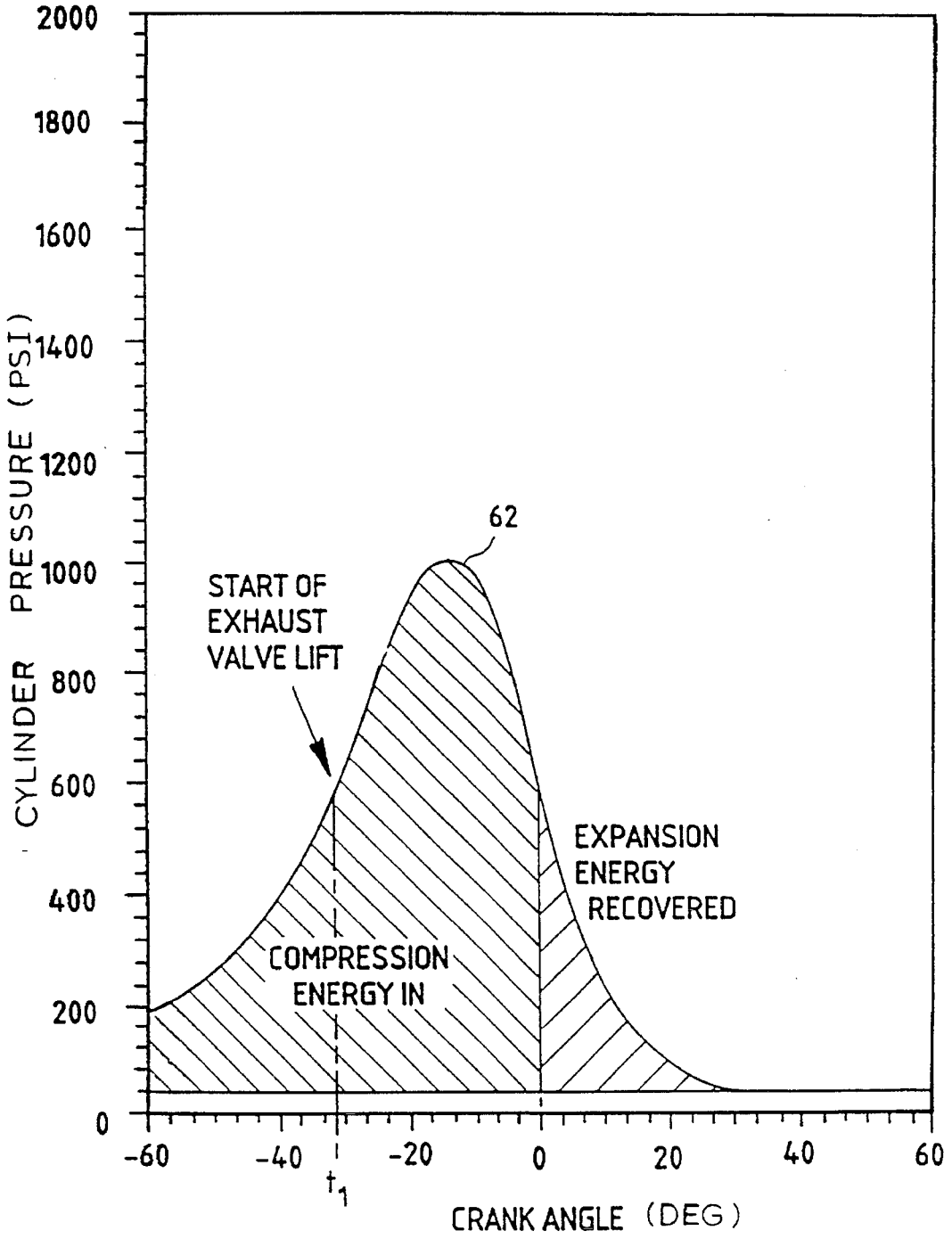
FIG. 3 comprises a graph illustrating cylinder pressure as a function of crankshaft angle in braking and motoring modes of operation of an engine.

The graphs of FIGS. 3 and 4A illustrate cylinder pressure and braking horsepower, respectively, as a function of crankshaft angle relative to top dead center (TDC). As seen in FIG. 3, during operation in a braking mode, the exhaust valves 40 of each cylinder 34 are opened at a time to prior to TDC so that the work expended in compressing the gases within the cylinder 34 is not recovered by the crankshaft 42. The resulting effective braking by the engine is proportional to the difference between the area under the curve 62 prior to TDC and the area under the curve 62 after TDC. This difference, and hence the effective braking, can be changed by changing the time $t_1$ at which the exhaust valves 40 are pumping is occurring, oil continuously flows through the conduits 80 and 82 to refill the pumps 88, 90.

In the preferred embodiment, the accumulator does not include a movable member, such as a piston or bladder, although such a movable member could be included therein, if desired. Further, the accumulator includes a pressure control valve 104 which vents engine oil to sump when a predetermined pressure is exceeded, for example 6,000 p.s.i.

The conduit 96 and accumulator 100 are further coupled to a pair of solenoid control valves 106, 108 and a pair of servo-actuators 110, 112. The servo-actuators 110, 112 are coupled by conduits 114, 116 to the pumps 88, 90 via the check valves 84, 86, respectively. The solenoid control valves 106, 108 are further coupled by conduits 118, 120 to sump.

As noted in greater detail hereinafter, when operation in the braking mode is selected by an operator, the ECM 72 closes the solenoid control valve 74 and operates the solenoid control valves 106, 108 to cause the servo-actuators 110, 112 to contact valve bridges 43 and open associated exhaust valves 40 in associated cylinders 34 near the end of a compression stroke. It should be noted that the control of FIG. 5 may be modified such that a different number of cylinders is serviced by each accumulator. In fact, by providing an accumulator with sufficient capacity, all of the engine cylinders may be served thereby.

Figure 6:
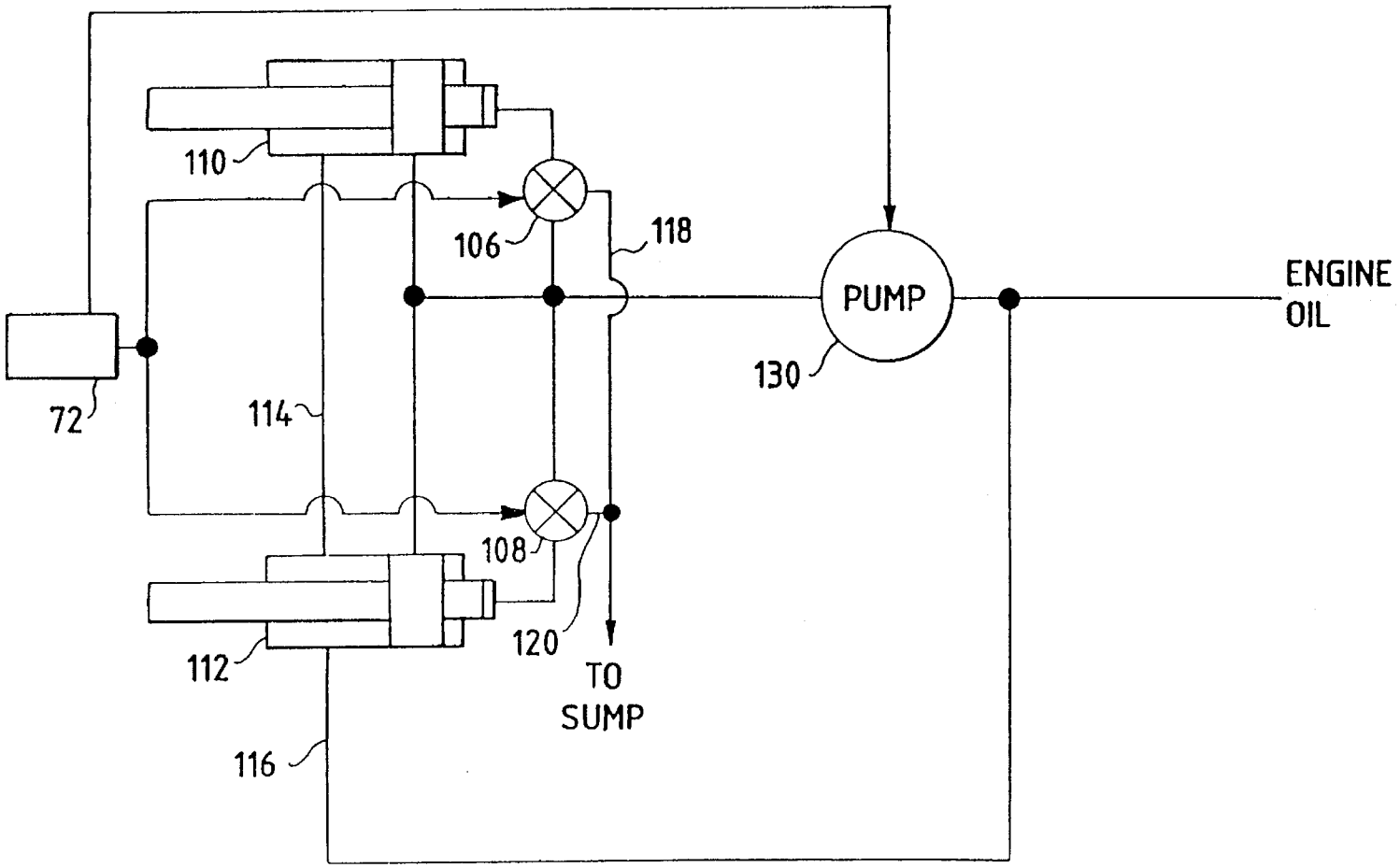
FIG. 6 comprises a combined block and schematic diagram of an alternative embodiment of the brake control of the present invention.

FIG. 6 illustrates an alternative embodiment of the present invention wherein elements common to FIGS. 5 and 6 are assigned like reference numbers. In the embodiment of FIG. 6, the solenoid control valve 74, the check valves 84, 86, 92 and 94 and the pumps 88 and 90 are replaced by a high pressure pump 130 which is controlled by the ECM 72 to pressurize engine oil to a high level, for example, 6,000 p.s.i.

FIGS. 7–17 illustrate mechanical hardware for implementing the control of FIG. 5. Referring first to FIGS. 7–11, a main body 132 includes a bridging portion 134. Threaded studs 135 extend through the main body 132 and spacers 136 into the head 41 and nuts 137 are threaded onto the studs 135. In addition, four bolts 138 extend through the main body 132 into the head 41. The bolts 138 replace rocker arm shaft hold down bolts and not only serve to secure the main body 132 to the head 41, but also extend through and hold a rocker arm shaft 139 in position.

A pair of actuator receiving bores 140, 142 are formed in the bridging portion 134. The servo-actuator 110 is received within the actuator receiving bore 140 while the servo-actuator 112 (not shown in FIGS. 7–17) is received within the receiving bore 142. Inasmuch as the actuators 110 and 112 are identical, only the actuator 110 will be described in greater detail hereinafter.

Figure 12:
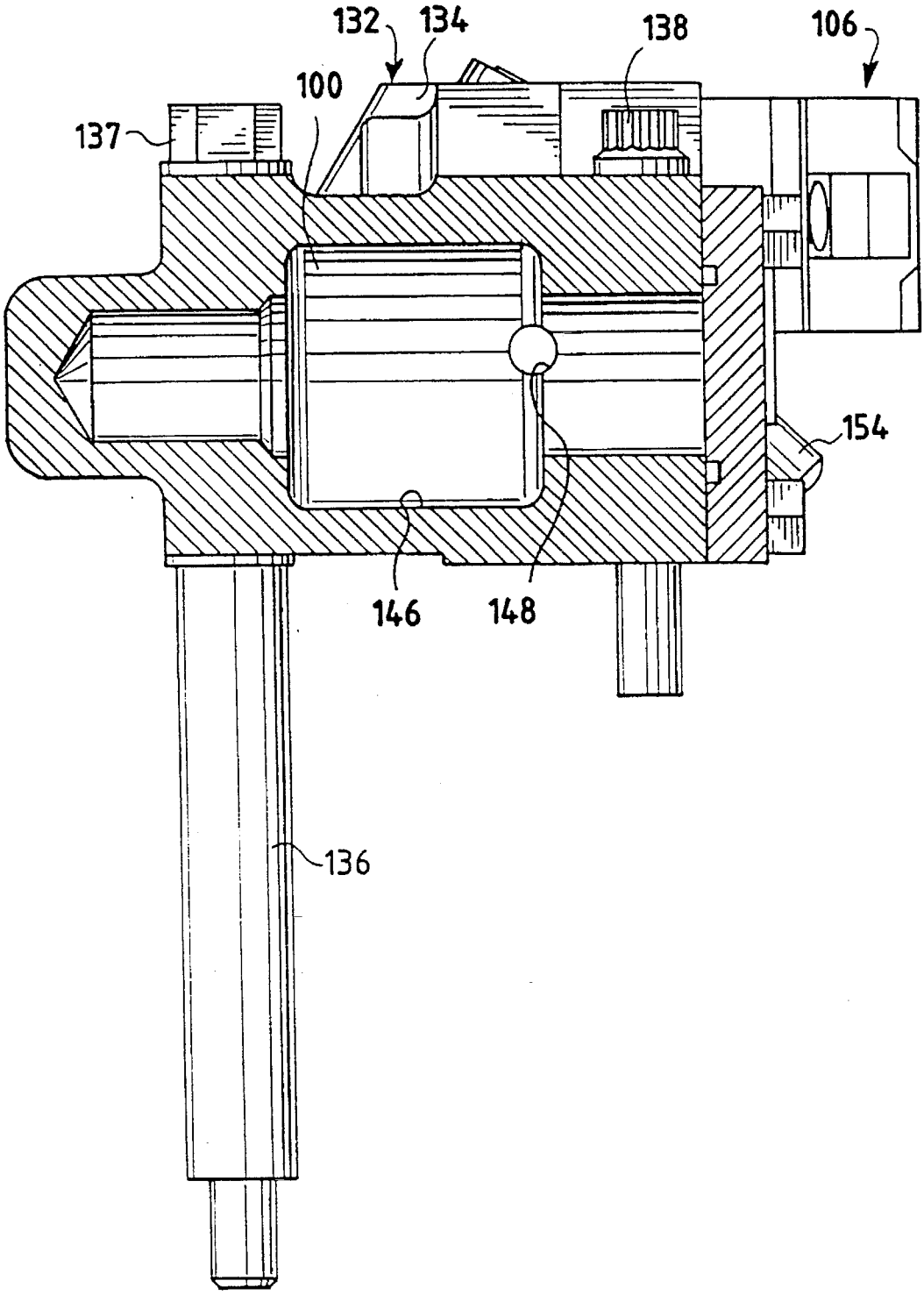
FIGS. 12, 13, 14, 15 and 17 are sectional views taken generally along the lines 12—12, 13—13, 14—14, 15—15 and 17—17, respectively, of FIG. 9.
Figure 13:
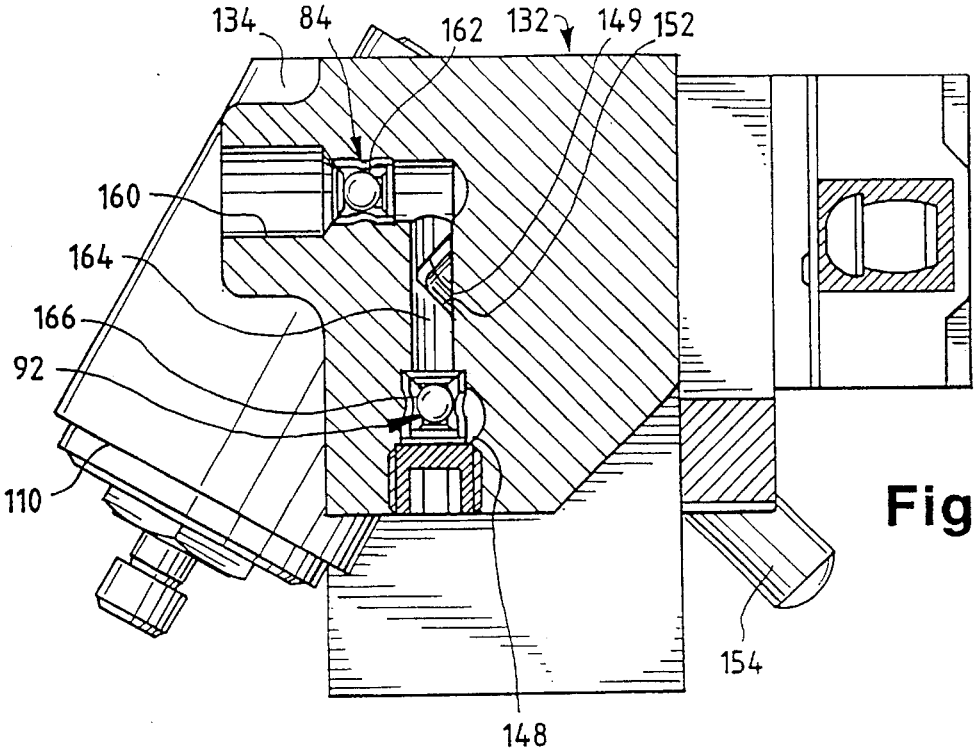
Figure 14:
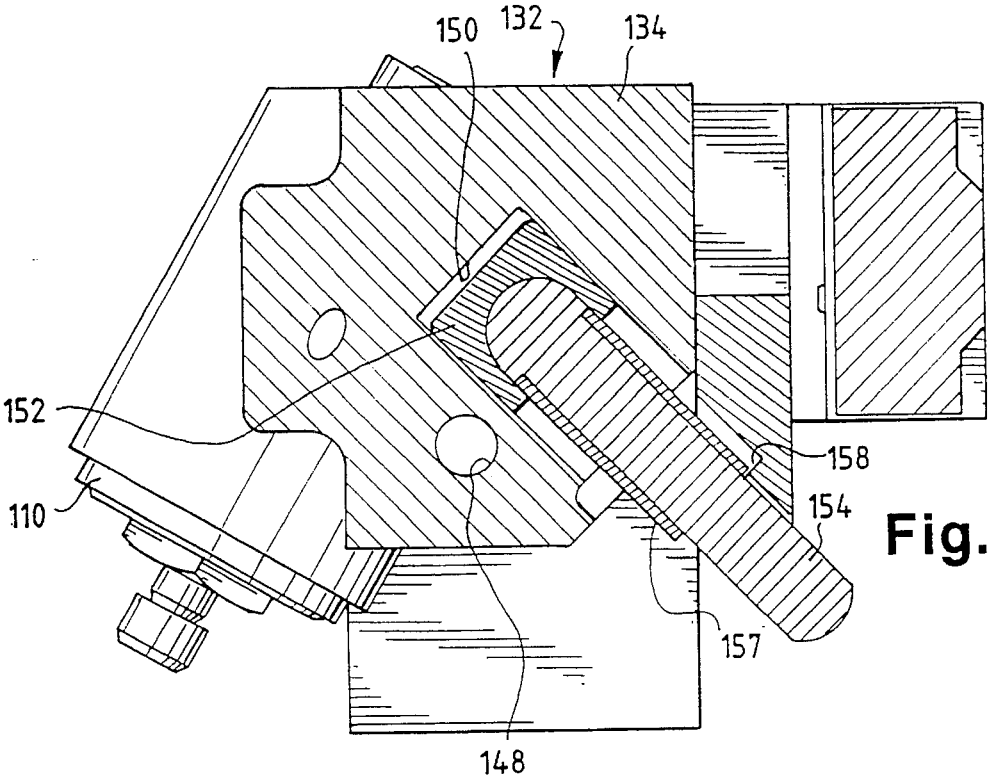

With specific reference to FIGS. 12–14, a cavity 146, seen in FIG. 12, is formed within the bridging portion 134 and comprises the accumulator 100 described above. The cavity 146 is in fluid communication with a high pressure passage or manifold 148 which is in turn coupled by the check valve 92 and a passage 149 to a bore 150 forming a portion of the pump unit 88. A piston 152 is disposed within the bore 150 (the top of which is just visible in FIG. 13) and is coupled to a connecting rod 154 which is adapted to contact a fuel injector rocker arm 156, seen in FIGS. 1 and 7. A spring 157 surrounds the connecting rod 154 and is disposed between a shoulder on the connecting rod 154 and a stop 158. With reference to FIG. 13, reciprocation of the fuel injector rocker arm 156 alternately introduces crankcase oil through an inlet fitting 159 (seen only in FIGS. 9 and 10) and a pump inlet passage 160 past a ball 162 of the check valve 84 into an intermediate passage 164 and expulsion of the pressurized oil from the intermediate passage 164 into the high pressure passage 148 past a ball 166 of the check valve 92. The pressurized oil is retained in the cavity 146 and further is supplied via the passage 148 to the actuator 110.

Figure 15:
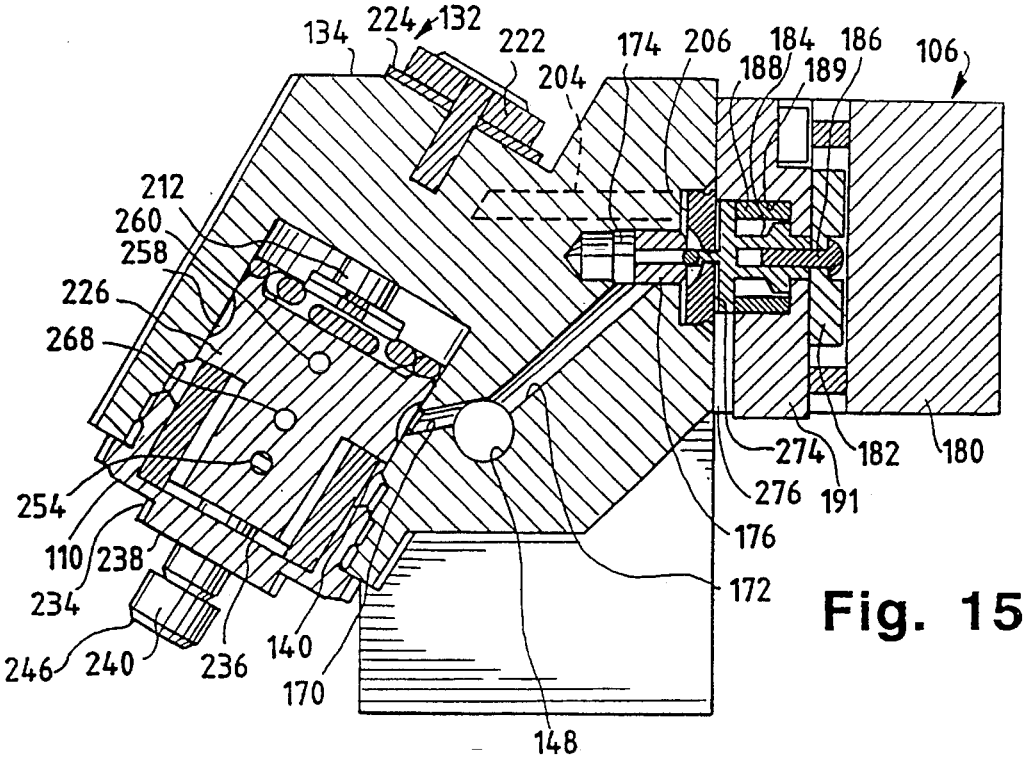
Figure 16:
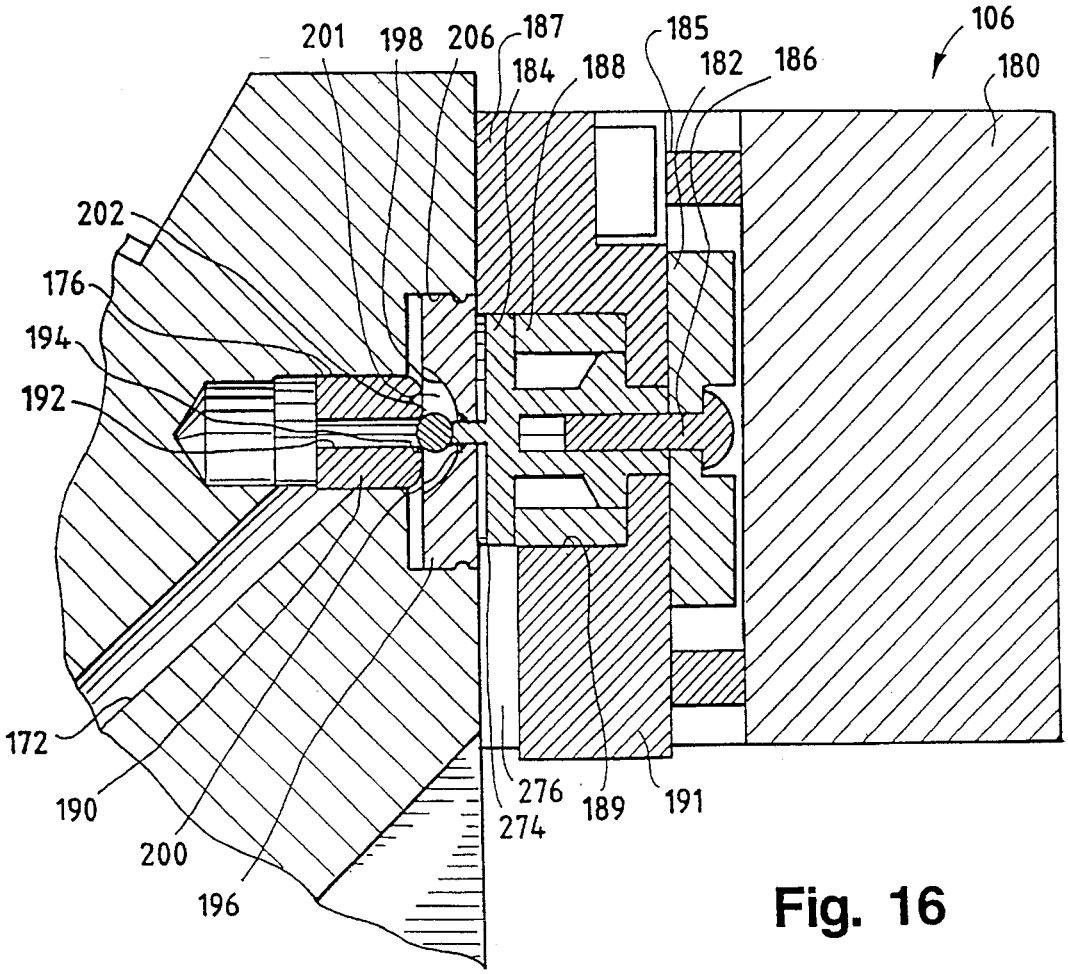
FIG. 16 is an enlarged fragmentary view of a portion of FIG. 15.

Referring now to FIGS. 15 and 16, the passage 148 is in fluid communication with passages 170, 172 leading to the actuator receiving bore 140 and a valve bore 174, respectively. A ball valve 176 is disposed within the valve bore 174. The solenoid control valve 106 is disposed adjacent the ball valve 176 and includes a solenoid winding shown schematically at 180, an armature 182 adjacent the solenoid winding 180 and in magnetic circuit therewith and a load adapter 184 secured to the armature 182 by a screw 186. The armature 182 is movable in a recess defined in part by the solenoid winding 180, an armature spacer 185 and a further spacer 187. The solenoid winding 180 is energizable by the ECM 72, as noted in greater detail hereinafter, to move the armature 182 and the load adapter 184 against the force exerted by a return spring illustrated schematically at 188 and disposed in a recess 189 located in a solenoid body 191.

The ball valve includes a rear seat 190 having a passage 192 therein in fluid communication with the passage 172 and a sealing surface 194. A front seat 196 is spaced from the rear seat 190 and includes a passage 198 leading to a sealing surface 200. A ball 202 resides in the passage 198 between the sealing surfaces 194 and 200. The passage 198 comprises a counterbore having a portion 201 which has been cross-cut by a keyway cutter to provide an oil flow passage to and from the ball area.

Figure 9:
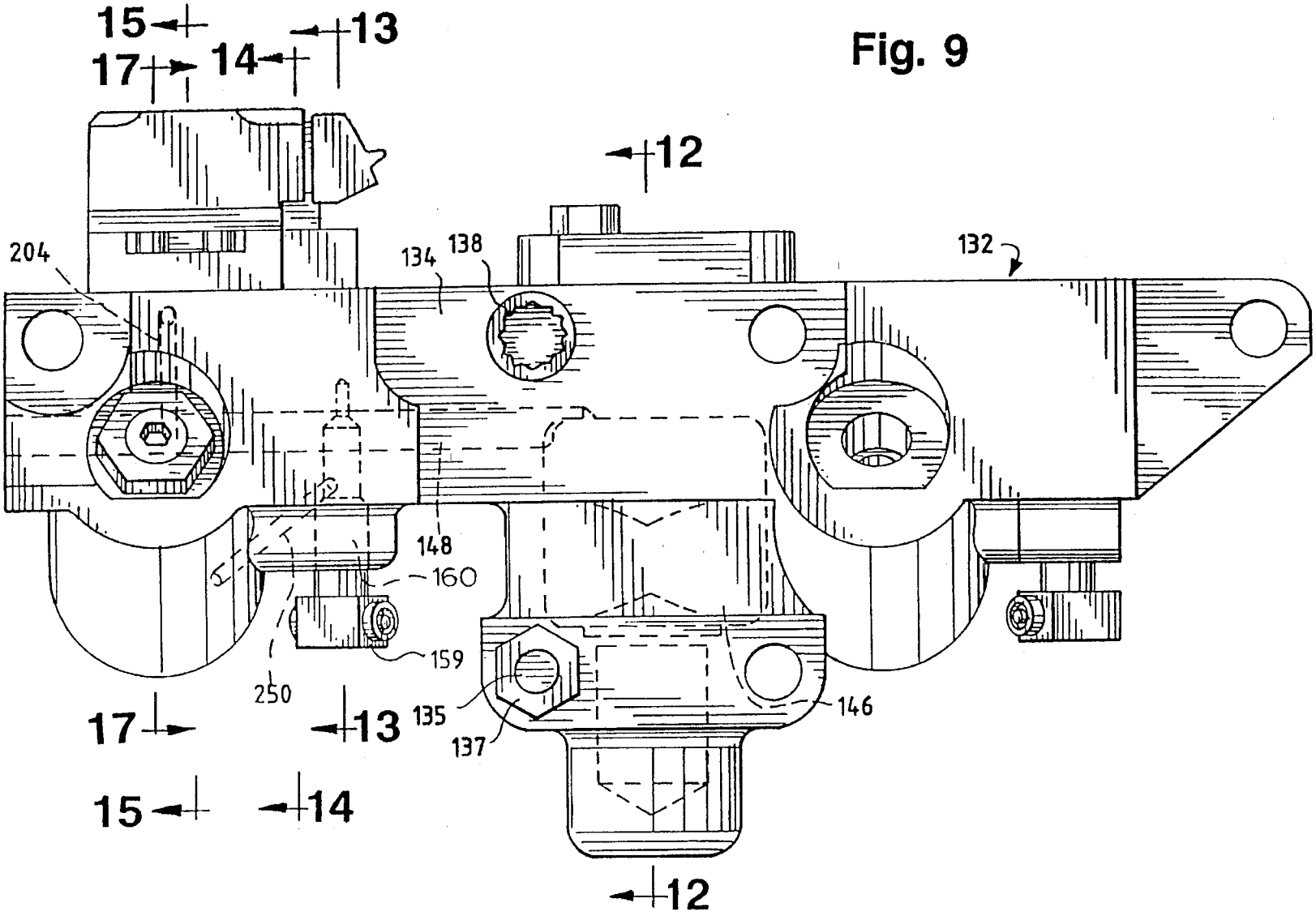
FIG. 9 comprises a plan view of the hardware of FIG. 7 with structures removed therefrom to the right of the section line 12—12 to more clearly illustrate the design thereof.
Figure 10:
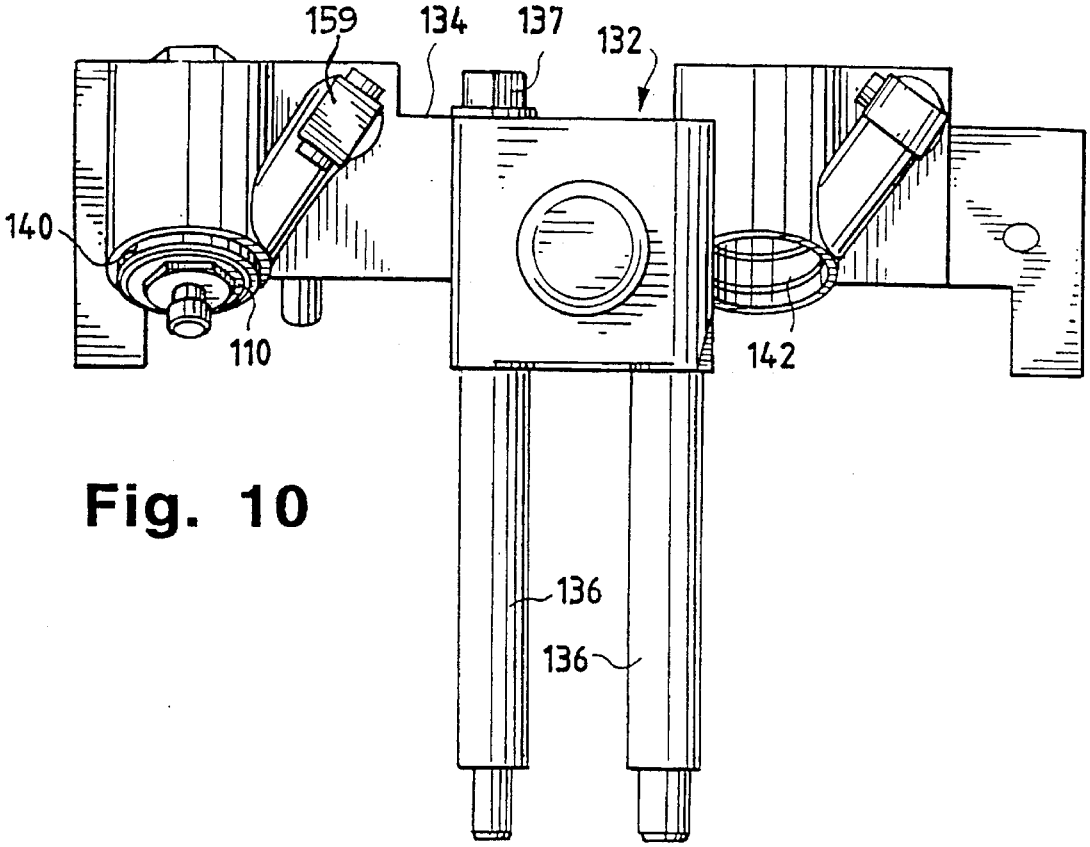
FIGS. 10 and 11 are front and rear elevational views, respectively, of the hardware of FIG. 9.
Figure 11:
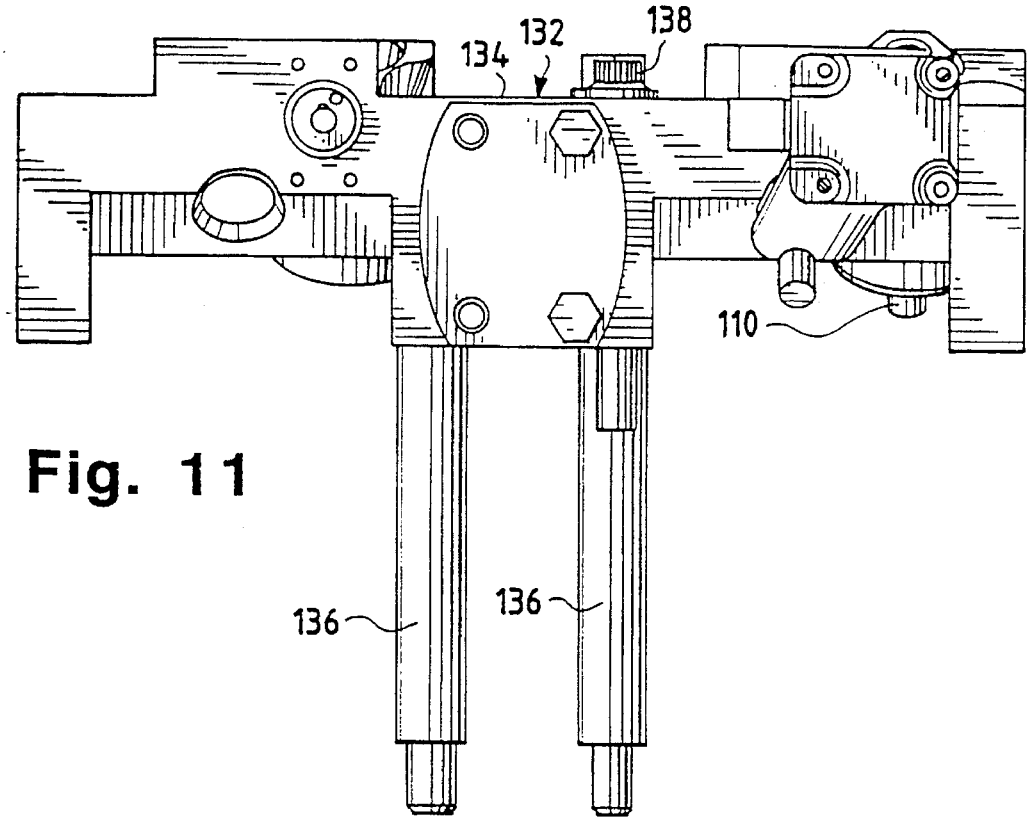
Figure 17:
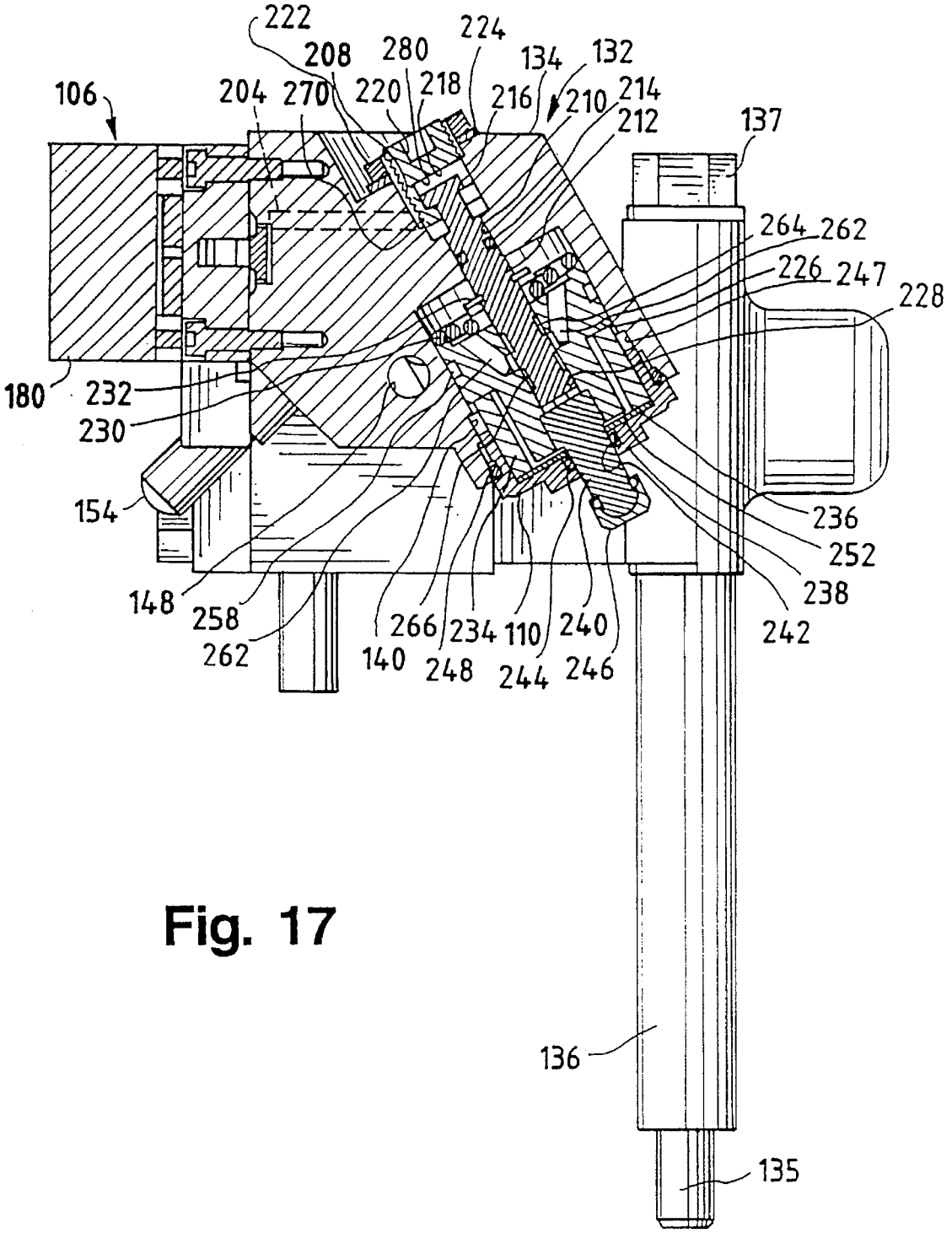

As seen in phantom in FIGS. 9 and 15, a passage 204 extends from a bore 206 containing the front seat 196 to an upper portion 208 of the receiving bore 140. As seen in FIG. 17, the receiving bore 140 further includes an intermediate portion 210 which closely receives a master fluid control device in the form of a valve spool 212 having a seal 214 which seals against the walls of the intermediate portion 210. The seal 214 is commercially available and is of two-part construction including a carbon fiber loaded teflon ring backed up and pressure loaded by an O-ring. The valve spool 212 further includes an enlarged head 216 which resides within a recess 218 of a lash stop adjuster 220. The lash stop adjuster 220 includes external threads which are engaged by a threaded nut 222 which, together with a washer 224, are used to adjust the axial position of the lash stop adjuster 220. The washer 224 is a commercially available composite rubber and metal washer which not only loads the adjuster 220 to lock the adjustment, but also seals the top of the actuator 110 and prevents oil leakage past the nut 222.

Figure 18:
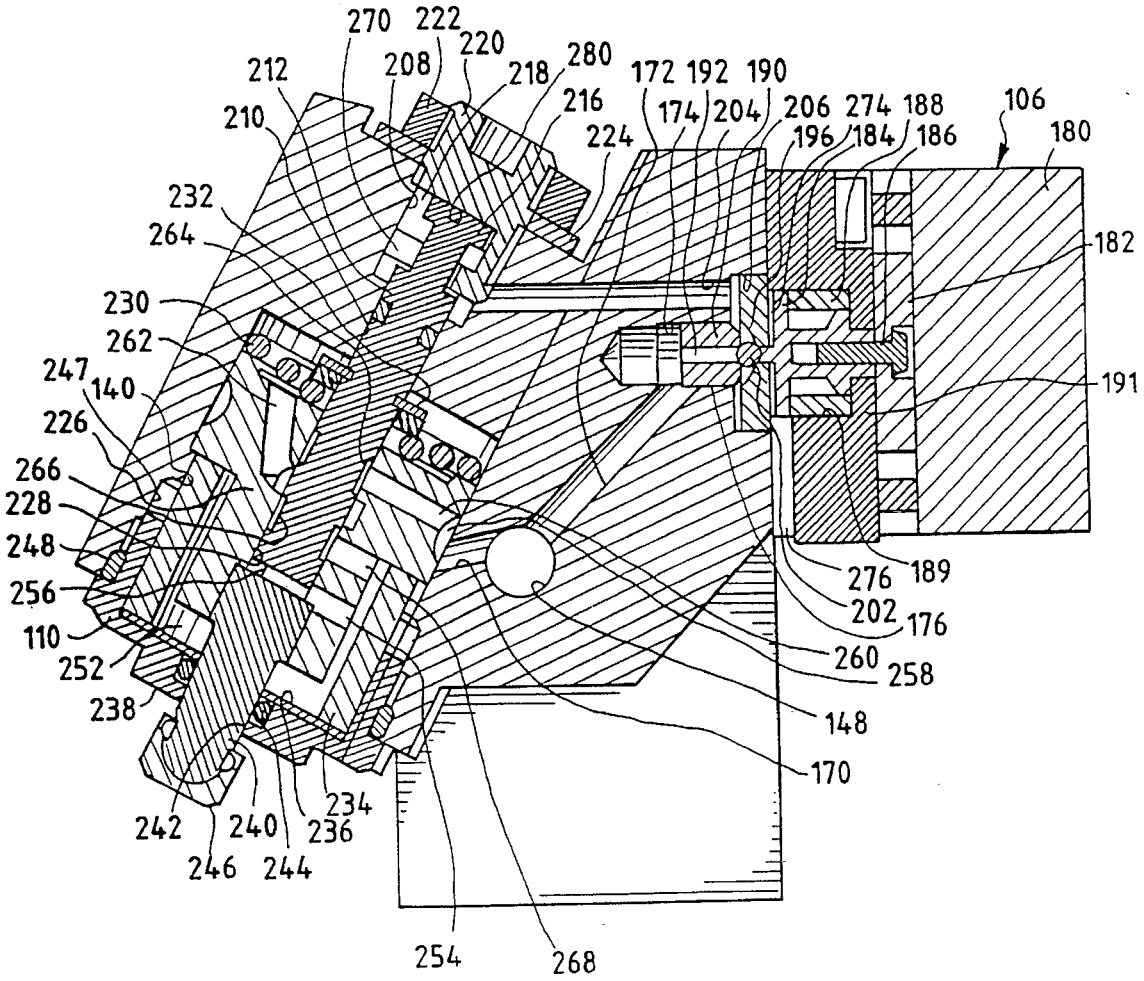
FIGS. 18 and 19 are composite sectional views illustrating the operation of the actuator of FIGS. 7–17.
Figure 19:
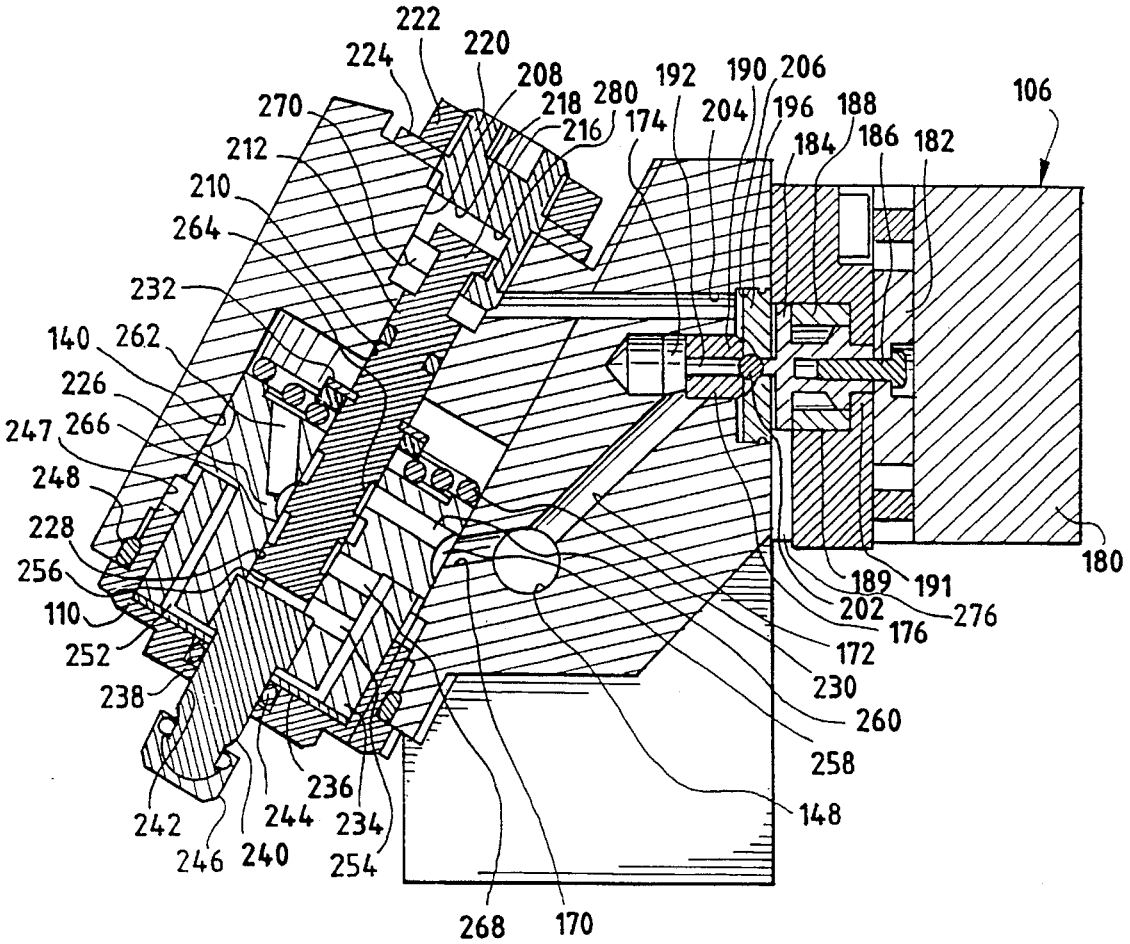

A slave fluid control device in the form of a piston 226 includes a central bore 228, seen in FIGS. 17–19, which receives a lower end of the spool 212. A spring 230 is placed in compression between a snap ring 232 carried in a groove in the spool 212 and an upper face of the piston 226. A return spring, shown schematically at 234, is placed in compression between a lower face of the piston 226 and a washer 236 placed in the bottom of a recess defined in part by an end cap 238. An actuator pin 240 is press-fitted within a lower portion of the central bore 228 so that the piston 226 and the actuator pin 240 move together. The actuator pin 240 extends outwardly through a bore 242 in the end cap 238 and an O-ring 244 prevents the escape of oil through the bore 242. In addition, a swivel foot 246 is pivotally secured to an end of the actuator pin 240.

The end cap 238 is threaded within a threaded portion 247 of the receiving bore 140 and an O-ring 248 provides a seal against leakage of oil.

As seen in FIG. 9, an oil return passage 250 extends between a lower recess portion 252, defined by the end cap 238 and the piston 226, and the inlet passage 160 just upstream of the check valve 84.

In addition to the foregoing, as seen in FIGS. 15, 18 and 19, an oil passage 254 is disposed between the lower recess portion 252 and a space 256 between the valve spool 212 and the actuator pin 240 to prevent hydraulic lock between these two components.

Industrial Applicability

FIGS. 18 and 19 are composite sectional views illustrating the operation of the present invention in detail. When braking is commanded by an operator and the solenoid 74 is actuated by the ECM 72, oil is supplied to the inlet passage 160 (seen in FIGS. 9 and 13). As seen in FIG. 13, the oil flows at supply pressure past the check valve 84 into the passage 149 and the bore 150, causing the piston 152 and the connecting rod 154 to move downwardly into contact with the fuel injector rocker arm against the force of the spring 157. Reciprocation of the connecting rod 154 by the fuel injector rocker arm 156 causes the oil to be pressurized and delivered to the passage 148. The pressurized oil is thus delivered through the passage 172 and the passage 192 in the rear seat 190, as seen in FIG. 18.

When the ECM 72 commands opening of the exhaust valves 40 of a cylinder 34, the ECM 72 energizes the solenoid winding 180, causing the armature 182 and the load adapter 184 to move to the right as seen in FIG. 18 against the force of the return spring 188. Such movement permits the ball 202 to also move to the right into engagement with the sealing surface 200 (FIG. 16) under the influence of the pressurized oil in the passage 192, thereby permitting the pressurized oil to pass in the space between the ball 202 and the sealing surface 194. The pressurized oil flows through the passage 198 and the bore 206 into the passage 204 and the upper portion 208 of the receiving bore 140. The high fluid pressure on the top of the valve spool 212 causes it to move downwardly. The spring rate of the spring 230 is selected to be substantially higher than the spring rate of the return spring 234, and hence movement of the valve spool 212 downwardly tends to cause the piston 226 to also move downwardly. Such movement continues until the swivel foot takes up the lash and contacts the exhaust rocker arm 55. At this point, further travel of the piston 226 is temporarily prevented owing to the cylinder compression pressures on the exhaust valves 40. However, the high fluid pressure exerted on the top of the valve spool 212 is sufficient to continue moving the valve spool 212 downwardly against the force of the spring 230. Eventually, the relative movement between the valve spool 212 and the piston 226 causes an outer high pressure annulus 258 and a high pressure passage 260 (FIGS. 15, 18 and 19) in fluid communication with the passage 170 to be placed in fluid communication with a piston passage 262 via an inner high pressure annulus 264. Further, a low pressure annulus 266 of the spool 212 is taken out of fluid communication with the piston passage 262.

Figure 7:
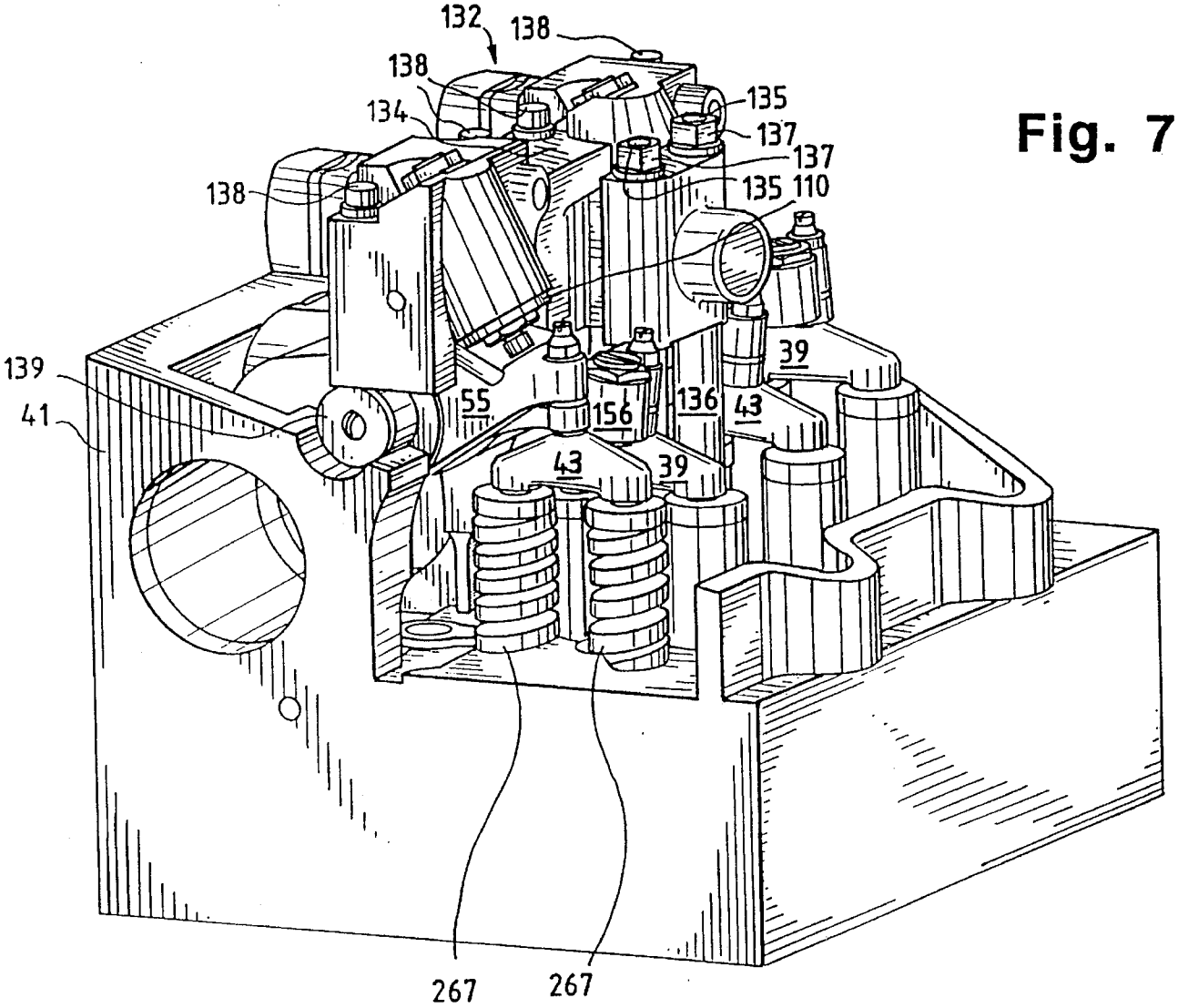
FIG. 7 comprises a perspective view of hydromechanical hardware for implementing the control of the present invention.
Figure 8:
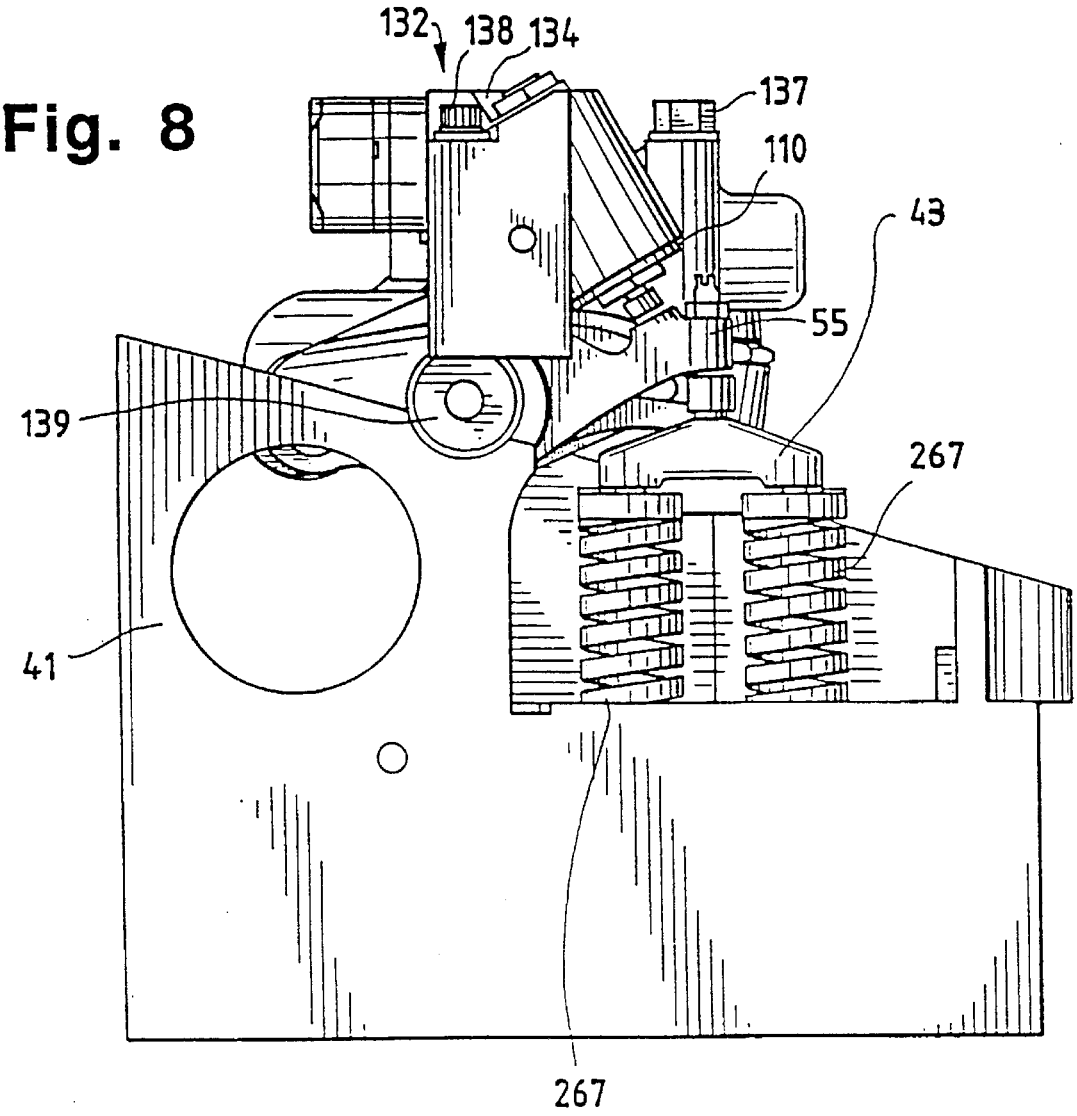
FIG. 8 comprises an end elevational view of the hardware of FIG. 7.

The high fluid pressure passing through the piston passage 262 acts on the large diameter of the piston 226 so that large forces are developed which cause the actuator pin 240 and the swivel foot 246 to overcome the resisting forces of the compression pressure and valve spring load exerted by valve springs 267 (FIGS. 7 and 8). As a result, the exhaust valves 40 open and allow the cylinder to start blowing down pressure. During this time, the valve spool 212 travels with the piston 226 in a downward direction until the enlarged head 216 of the valve spool 212 contacts a lower portion 270 of the lash stop adjuster 220. At this point, further travel of the valve spool 212 in the downward direction is prevented while the piston 226 continues to move downwardly. As seen in FIG. 19, the inner high pressure annulus 264 is eventually covered by the piston 226 and the low pressure annulus 266 is uncovered. The low pressure annulus 266 is coupled by a passage 268 (FIGS. 15, 18 and 19) to the lower recess portion 252 which, as noted previously, is coupled by the oil return passage 250 to the pump inlet 160. Hence, at this time, the piston passage 262 and the upper face of the piston 226 are placed in fluid communication with low pressure oil. High pressure oil is vented from the cavity above the piston 226 and the exhaust valves 40 stop in the open position.

Thereafter, the piston 226 slowly oscillates between a first position, at which the inner high pressure annulus 264 is uncovered, and a second position, at which the low pressure annulus 266 is uncovered, to vent oil as necessary to maintain the exhaust valves 40 in the open position as the cylinder 34 blows down. During the time that the exhaust valves 40 are in the open position, the ECM 72 provides drive current according to a predetermined schedule to provide good coil life and low power consumption.

When the exhaust valves 40 are to be closed, the ECM 72 terminates current flow in the solenoid winding 180. The return spring 188 then moves the load adapter 184 to the left as seen in FIGS. 18 and 19 so that the ball 202 is forced against the sealing surface 194 of the rear seat 190. The high pressure fluid above the valve spool 212 flows back through the passage 204, the bore 206, a gap 274 between the load adapter 184 and the front seat 196 and a passage 276 to the oil sump. In response to the venting of high pressure oil, the valve spool 212 is moved upwardly under the influence of the spring 230. As the valve spool 212 moves upwardly, the low pressure annulus 266 is uncovered and the high pressure annulus 258 is covered by the piston 226, thereby causing the high pressure oil above the piston 226 to be vented. The return spring 234 and the exhaust valve springs 267 force the piston 226 upwardly and the exhaust valves 40 close. The closing velocity is controlled by the flow rate past the ball 202 into the passage 276. The valve spool 212 eventually seats against an upper surface 280 of the lash stop adjuster 220 and the piston 226 returns to the original position as a result of venting of oil through the inner high pressure annulus 264 and the low pressure annulus 266 such that the passage 268 is in fluid communication with the latter. As should be evident to one of ordinary skill in the art, the stopping position of the piston 226 is dependent upon the spring rates of the springs 230, 234. Oil remaining in the lower recess portion 252 is returned to the pump inlet 160 via the oil return passage 250.

The foregoing sequence of events is repeated each time the exhaust valves 40 are opened.

When the braking action of the engine is to be terminated, the ECM 72 closes the solenoid valve 74 and rapidly cycles the solenoid control valve 106 (and the other solenoid control valves) a predetermined number of cycles to vent off the stored high pressure oil to sump.

Figure 20:
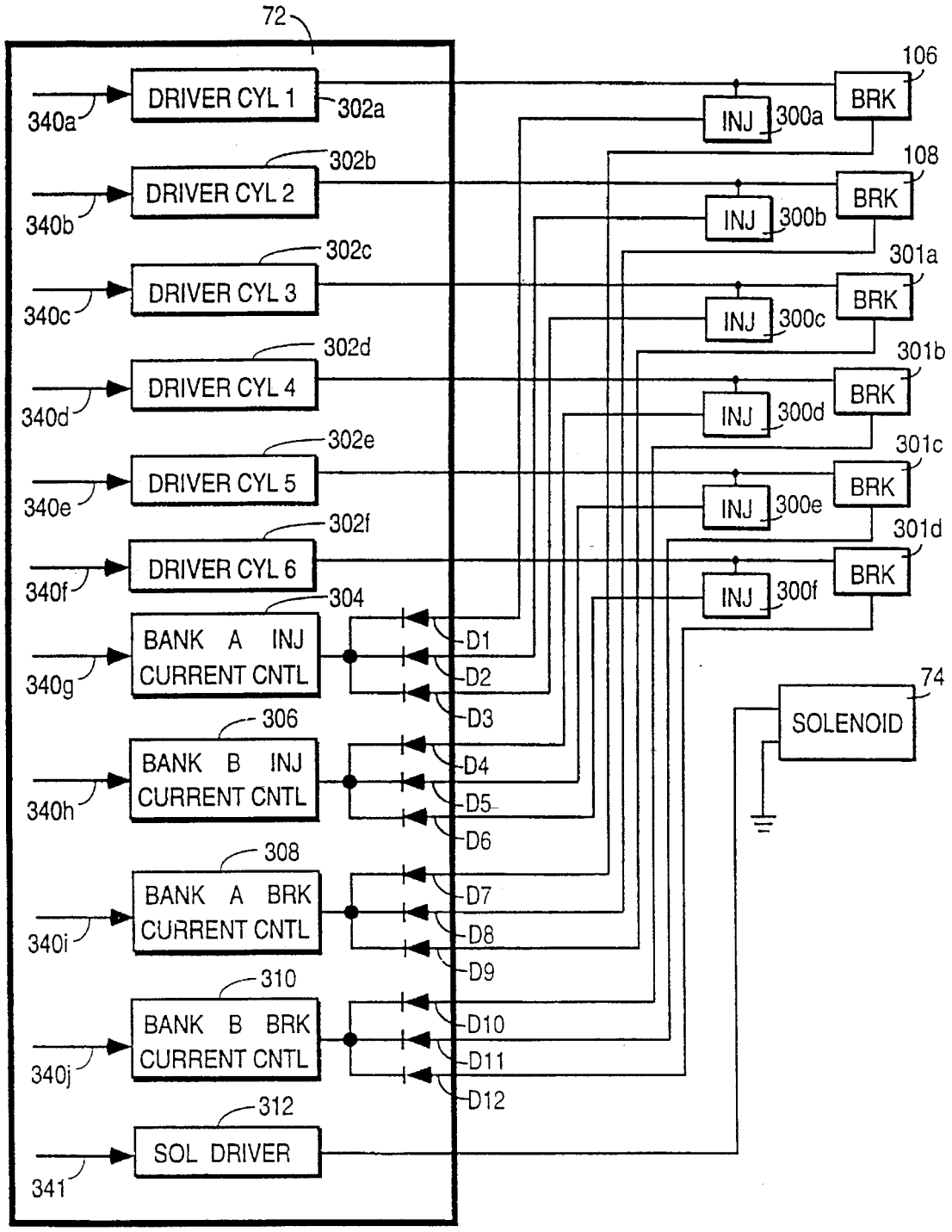
FIG. 20 is a block diagram illustrating output and driver circuits of an engine control module (ECM), a plurality of unit injectors and a plurality of braking controls according to the present invention.
Figure 21:
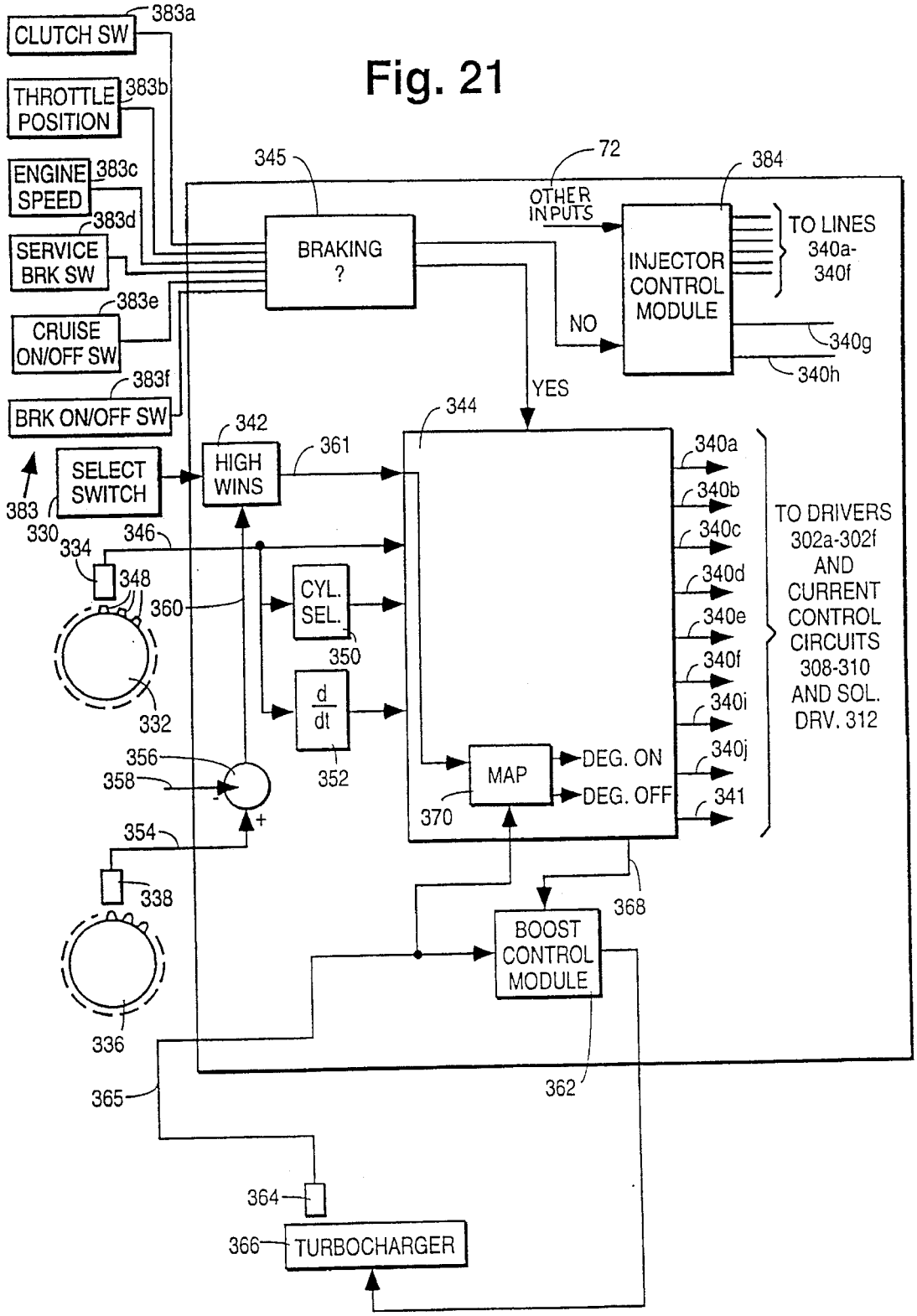
FIG. 21 comprises a block diagram of the balance of electrical hardware of the ECM.

FIG. 20 and 21 illustrate output and driver circuits of the ECM 72 as well as the wiring interconnections between the ECM 72 and a plurality of electronically controlled unit fuel injectors 300*a*–300*f*, which are individually operated to control the flow of fuel into the engine cylinders 34, and the solenoid control valves of the present invention, here illustrated as including the solenoid control valves 106, 108 and additional solenoid valves 301*a*–301*d*. Of course, the number of solenoid control valves would vary from that shown in FIG. 20 in dependence upon the number of cylinders to be used in engine braking. The ECM 72 includes six solenoid drivers 302*a*–302*f*, each of which is coupled to a first terminal of and associated with one of the injectors 300*a*–300*f* and one of the solenoid control valves 106, 108 and 301*a*–301*d*, respectively. Four current control circuits 304, 306, 308 and 310 are also included in the ECM 72. The current control circuit 304 is coupled by diodes D1–D3 to second terminals of the unit injectors 300*a*–300*c*, respectively, while the current control circuit 306 is coupled by diodes D4–D6 to second terminals of the unit injectors 300*d*–300*f*, respectively. In addition, the current control circuit 308 is coupled by diodes D7–D9 to second terminals of the brake control solenoids 106, 108 and 301*a*, respectively, whereas the current control circuit 310 is coupled by diodes D10–D12 to second terminals of the brake control solenoids 301*b*–301*d*, respectively. Also, a solenoid driver 312 is coupled to the solenoid 74.

In order to actuate any particular device 300*a*–300*f*, 106, 108 or 301*a*–301*d*, the ECM 72 need only actuate the appropriate driver 302*a*–302*f* and the appropriate current control circuit 304–310. Thus, for example, if the unit injector 300*a* is to be actuated, the driver 302*a* is operated as is the current control circuit 304 so that a current path is established therethrough. Similarly, if the solenoid control valve 301*d* is to be actuated, the driver 302*f* and the current control circuit 310 are operated to establish a current path through the control valve 301*d*. In addition, when one or more of the control valves 106, 108 or 301*a*–301*d* are to be actuated, the solenoid driver 312 is operated to deliver current to the solenoid 74, except when the solenoid control valve 106 is rapidly cycled as noted above.

It should be noted that when the ECM 72 is used to operate the fuel injectors 300*a*–300*f* alone and the brake control solenoids 106, 108 and 301*a*–301*d* are not included therewith, a pair of wires are connected between the ECM 72 and each injector 300*a*–300*f*. When the brake control solenoids 106, 108 and 301*a*–301*d* are added to provide engine braking capability, the only further wires that must be added are a jumper wire at each cylinder interconnecting the associated brake control solenoid and fuel injector and a return wire between the second terminal of each brake control solenoid and the ECM 72. The diodes D1–D12 permit multiplexing of the current control circuits 304–310; i.e., the current control circuits 304–310 determine whether an associated injector or brake control is operating. Also, the current versus time wave shapes for the injectors and/or solenoid control valves are controlled by these circuits.

FIG. 21 illustrates the balance of the ECM 72 in greater detail, and, in particular, circuits for commanding proper operation of the drivers 302*a*–302*f* and the current control circuits 304, 306, 308 and 310. The ECM 72 is responsive to the output of a select switch 330, a cam wheel 332 and a sensor 334 and a drive shaft gear 336 and a sensor 338. The ECM 72 develops drive signals on lines 340*a*–340*j* which are provided to the drivers 302*a*–302*f* and to the current control circuits 304, 306, 308 and 310, respectively, to properly energize the windings of the solenoid control valves 106, 108 and 301*a*–301*d*. In addition, a signal is developed on a line 341 which is supplied to the solenoid driver 312 to operate same. The select switch 330 may be manipulated by an operator to select a desired magnitude of braking, for example, in a range between zero and 100% braking. The output of the select switch 330 is passed to a high wins circuit 342 in the ECM 72, which in turn provides an output to a braking control module 344 which is selectively enabled by a block 345 when engine braking is to occur, as described in greater detail hereinafter. The braking control module 344 further receives an engine position signal developed on a line 346 by the cam wheel 332 and the sensor 334. The cam wheel is driven by the engine camshaft 46 (which is in turn driven by the crankshaft 42 as noted above) and includes a plurality of teeth 348 of magnetic material, three of which are shown in FIG. 21, and which pass in proximity to the sensor 334 as the cam wheel 332 rotates. The sensor 334, which may be a Hall effect device, develops a pulse type signal on the line 346 in response to passage of the teeth 348 past the sensor 334. The signal on the line 346 is also provided to a cylinder select circuit 350 and a differentiator 352. The differentiator 352 converts the position signal on the line 346 into an engine speed signal which, together with the cylinder select circuit 350 and the signal developed on the line 346, instruct the braking control module 344, when enabled, to provide control signals on the lines 340*a*–340*f* with the proper timing. Further, when the braking control module 344 is enabled, a signal is developed on the line 341 to activate the solenoid drive 312 and the solenoid 74.

The sensor 338 detects the passage of teeth on the gear 336 and develops a vehicle speed signal on a line 354 which is provided to a noninverting input of a summer 356. An inverting input of the summer 356 receives a signal on a line 358 representing a desired speed for the vehicle. The signal on the line 358 may be developed by a cruise control or any other speed setting device. The resulting error signal developed by the summer 356 is provided to the high wins circuit 342 over a line 360. The high wins circuit 342 provides the signal developed by the select switch 330 or the error signal on the line 360 to the braking control module 344 as a signal % BRAKING on a line 361 in dependence upon which signal has the higher magnitude. If the error signal developed by the summer 356 is negative in sign and the signal developed by the select switch 330 is at a magnitude commanding no (or 0%) braking, the high wins circuit 342 instructs the braking control module 344 to terminate engine braking.

A boost control module 362 is responsive to a signal, called BOOST, developed by a sensor 364 on a line 365 which detects the magnitude of intake manifold air pressure of a turbocharger 366 of the engine 30. In the preferred embodiment, the turbocharger 366 has a variable blade geometry which allows boost level to be controlled by the boost control module 362. The module 362 receives a limiter signal on a line 368 developed by the braking control module 344 which allows for as much boost as the turbocharger 366 can develop under the current engine conditions but prevents the boost control module from increasing boost to a level which would cause damage to engine components.

Figure 22:
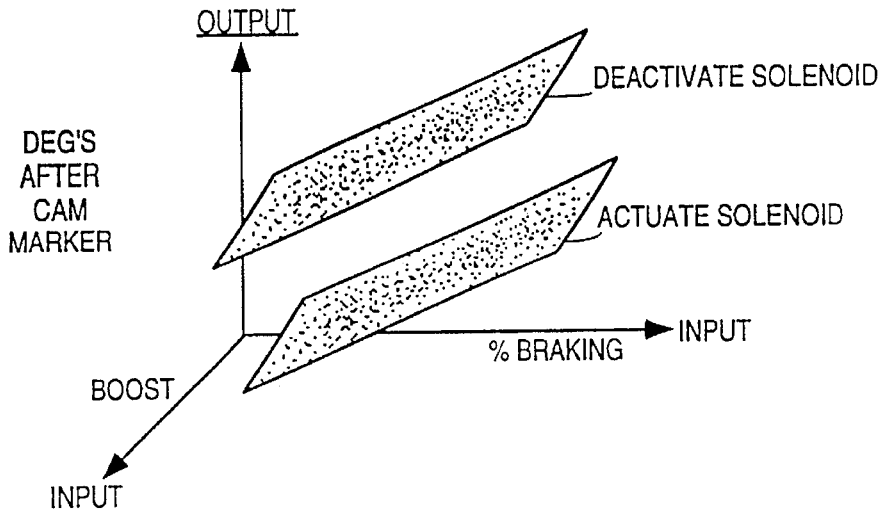
FIG. 22 comprises a three-dimensional representation of a map relating solenoid control valve actuation and deactuation timing as a function of desired braking magnitude and turbocharger boost magnitude.

The braking control module includes a lookup table or map 370 which is addressed by the signals % BRAKING and BOOST on the lines 361 and 365, respectively, and provides output signals DEG. ON and DEG. OFF to the control of FIG. 23. FIG. 22 illustrates in three dimensional form the contents of the map 370 including the output signals DEG. ON and DEG. OFF as a function of the addressing signals % BRAKING and BOOST. The signals DEG. ON and DEG. OFF indicate the timing of solenoid control valve actuation and deactuation, respectively, in degrees after a cam marker signal is produced by the cam wheel 332 and the sensor 334. Specifically, the cam wheel 332 includes 24 teeth, 21 of which are identical to one another and each of which occupies 80% of a tooth pitch with a 20% gap. Two of the remaining three teeth are adjacent to one another (i.e., consecutive) while the third is spaced therefrom and each occupies 50% of a tooth pitch with a 50% gap. The ECM 72 detects these non-uniformities to determine when cylinder number 1 of the engine 30 reaches TDC between compression and power strokes as well as engine rotation direction.

The signal DEG ON is provided to a computational block 372 which is responsive to the engine speed signal developed by the block 352 of FIG. 21 and which develops a signal representing the time after a reference point or marker on the cam wheel 332 passes the sensor 334 at which a signal on one of the lines **340*a*–340*f* is to be switched to a high state. In like fashion, a computational block 374 is responsive to the engine speed signal developed by the block 352 and develops a signal representing the time after the reference point passes the sensor 334 at which the signal on the same line 340*a*–340*f* is to be switched to an off state. The signals from the blocks 372, 374 are supplied to delay blocks 376, 378, respectively, which develop on and off signals for a solenoid driver block 380 in dependence upon the marker developed by the cam wheel 332 and the sensor 334 and in dependence upon the particular cylinder which is to be employed next in braking. The signal developed by the delay block 376 comprises a narrow pulse having a leading edge which causes the solenoid driver block 380 to develop an output signal having a transition from a low state to a high state whereas the timer block 378 develops a narrow pulse having a leading edge which causes the output signal developed by the solenoid driver circuit 380 to switch from a high state to a low state. The signal developed by solenoid driver circuit 380 is routed to the appropriate output line 340*a*–340*f* by a cylinder select switch 382 which is responsive to the cylinder select signal developed by the block 350 of FIG. 21**.

The braking control module 344 is enabled by the block 345 in dependence upon certain sensed conditions as detected by sensors/switches 383. The sensors/switches include a clutch switch **383*a* which detects when a clutch of the vehicle is engaged by an operator (i.e., when the vehicle wheels are disengaged from the vehicle engine), a throttle position switch 383*b* which detects when a throttle pedal is depressed, an engine speed sensor 383*c* which detects the speed of the engine, a service brake switch 383*d* which develops a signal representing whether the service brake pedal of the vehicle is depressed, a cruise control on/off switch 383*e* and a brake on/off switch 383*f*. If desired, the output of the circuit 352 may be supplied in lieu of the signal developed by the sensor 383*c*, in which case the sensor 383*c* may be omitted. According to a preferred embodiment of the present invention, the braking control module 344 is enabled when the on/off switch 383*f* is on, the engine speed is above a particular level, for example 950 rpm, the driver's foot is off the throttle and clutch and the cruise control is off. The braking control module 344 is also enabled when the on/off switch 383*f* is on, engine speed is above the certain level, the driver's foot is off the throttle and clutch, the cruise control is on and the driver depresses the service brake. Under the second set of conditions, and also in accordance with the preferred embodiment, a "coast" mode may be employed wherein engine braking is engaged only while the driver presses the service brake, in which case, the braking control module 344 is disabled when the driver's foot is removed from the service brake. According to an optional "latched" mode of operation operable under the second set of conditions as noted above, the braking control module 344 is enabled by the block 345 once the driver presses the service brake and remains enabled until another input, such as depressing the throttle or selecting 0% braking by means of the switch 330**, is supplied.

The block 345 enables an injector control module 384 when the braking control module 344 is disabled, and vice versa. The injector control module 384 supplies signals over the lines **340*a*–340*f* as well as over lines 340*g* and 340*h* to the current control circuits 304 and 306 of FIG. 20** so that fuel injection is accomplished.

Referring again to FIG. 23, the signal developed by the solenoid driver circuit 380 is also provided to a current control logic block 386 which in turn supplies signals on lines **340*i*, 340*j* of appropriate waveshape and synchronization with the signals on the lines 340*a*–340*f* to the blocks 308 and 310 of FIG. 20**. Programming for effecting this operation is completely within the abilities of one of ordinary skill in the art and will not be described in detail herein.

Figure 23:
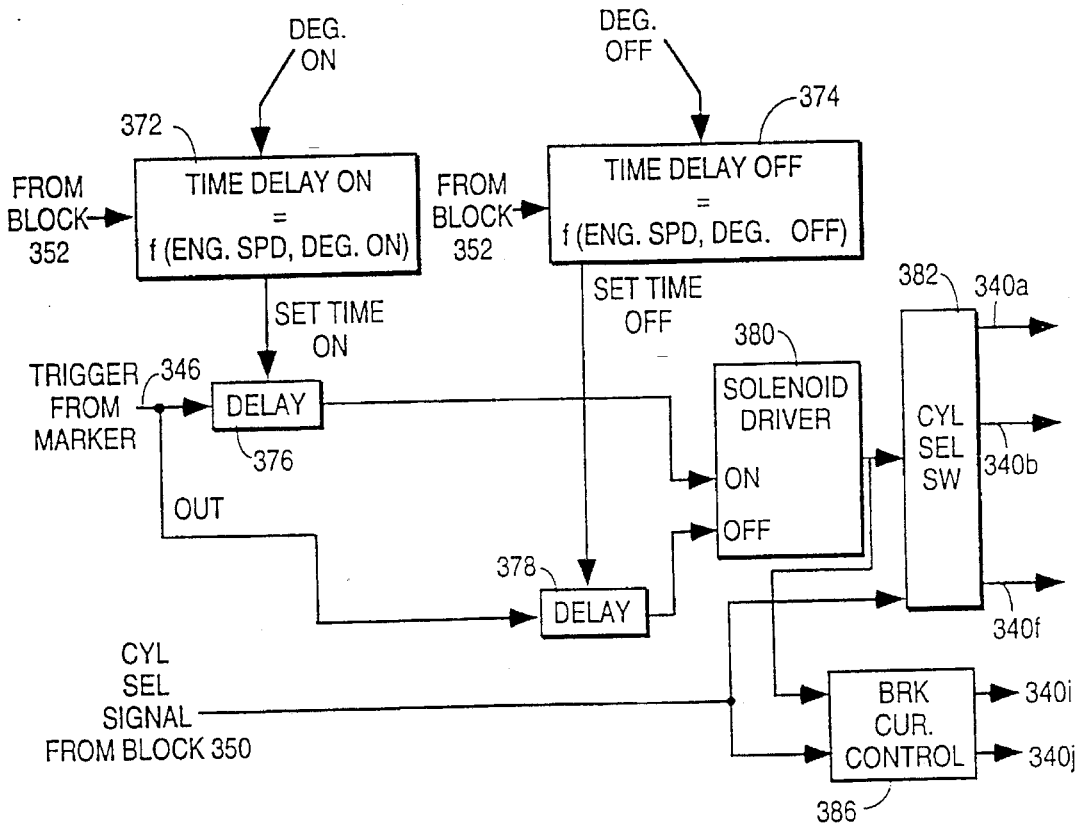
FIG. 23 comprises a block diagram of software executed by the ECM to implement the braking control module of FIG. 21.

It should be noted that any or all of the elements represented in FIGS. 21 and 23 may be implemented by software, hardware or by a combination of the two.

The foregoing system permits a wide degree of flexibility in setting both the timing and duration of exhaust valve opening. This flexibility results in an improvement in the maximum braking achievable within the structural limits of the engine. Also, braking smoothness is improved inasmuch as all of the cylinders of the engine can be utilized to provide braking. In addition, smooth modulation of braking power from zero to maximum can be achieved owing to the ability to precisely control timing and duration of exhaust valve opening at all engine speeds. Still further, in conjunction with a cruise control as noted above, smooth speed control during downhill conditions can be achieved.

Moreover, the use of a pressure-limited bulk modulus accumulator permits setting of a maximum accumulator pressure which prevents damage to engine components. Specifically, with the accumulator maximum pressure properly set, the maximum force applied to the exhaust valves can never exceed a preset limit regardless of the time of the valve opening signal. If the valve opening signal is developed at a time where cylinder pressures are extremely high, the exhaust valves simply will not open rather than causing a structural failure of the system.

Also, by recycling oil back to the pump inlet passage 160 from the actuator 110 during braking, demands placed on an oil pump of the engine are minimized once braking operation is implemented.

It should be noted that the integration of a cruise control and/or a turbocharger control in the circuitry of FIG. 21 is optional. In fact, the circuitry of FIG. 21 may be modified in a manner evident to one of ordinary skill in the art to implement use of a traction control therewith whereby braking horsepower is modulated to prevent wheel slip, if desired.

The integration of the injector and braking wiring and connections to the ECM permits multiple use of drivers, control logic and wiring and thus involves little additional cost to achieve a robust and precise brake control system.

In summary, the control of the present invention provides sufficient force to open multiple exhaust valves against in-cylinder compression pressures high enough to achieve desired engine braking power levels and allows adjustment of the free travel or lash between the actuator and the exhaust valve rocker arm. In addition, the total travel of the actuator is controlled to prevent valve-to-piston interference and to prevent high impact loads in the actuator. Still further, the opening and closing velocities of the exhaust valves can be controlled.

As the foregoing discussion demonstrates, engine braking can be accomplished by opening the exhaust valves in some or all of the engine cylinders at a point just prior to TDC. As an alternative, the exhaust valve(s) associated with each cylinder may also be opened at a point near bottom dead center (BDC) so that cylinder pressure is boosted. This increased cylinder pressure causes a larger braking force to be developed owing to the increased retarding effect on the engine crankshaft.

Figure 25:
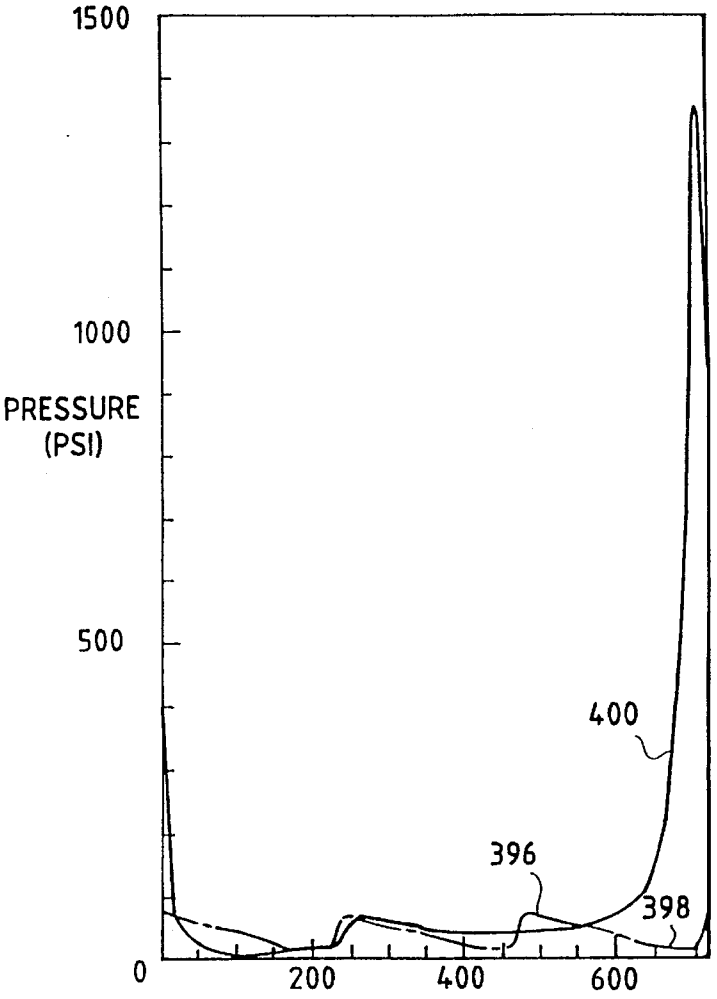
FIG. 25 is a graph illustrating cylinder pressure and exhaust manifold pressure as a function of crankshaft angle.
Figure 24:
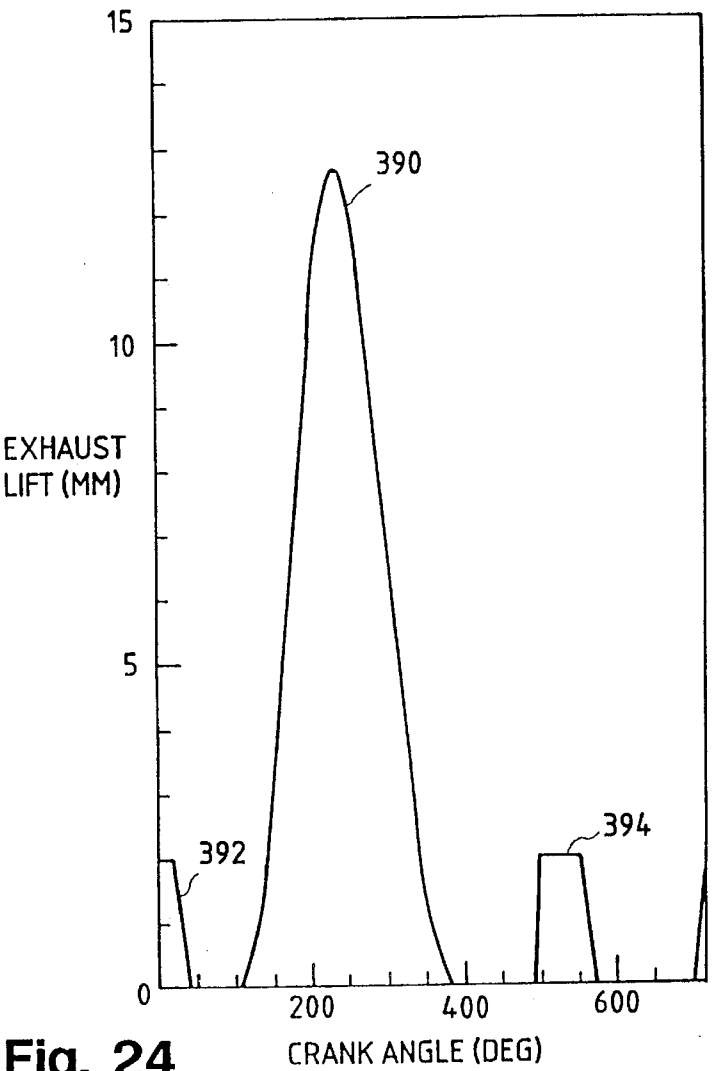
FIG. 24 is a graph illustrating exhaust valve lift as a function of crankshaft angle.

More specifically, as seen in FIGS. 24 and 25, in addition to the usual exhaust valve opening, event illustrated by the curve 390 during the exhaust stroke of the engine and the exhaust valve opening event represented by the curve 392 surrounding top dead center at the end of a compression stroke as implemented by the exhaust control described previously, a further exhaust valve opening event is added near BDC, as represented by the curve 394. This event, which is added by suitable programming of the ECM 72 in a manner evident to one of ordinary skill in the art, permits a pressure spike arising in the exhaust manifold of the engine and represented by the portion 396 of an exhaust manifold pressure curve 398, to boost the pressure in the cylinder just prior to compression. This boosting results in a pressure increase over the cylinder pressure represented by the curve 400 of FIG. 25.

Figure 26:
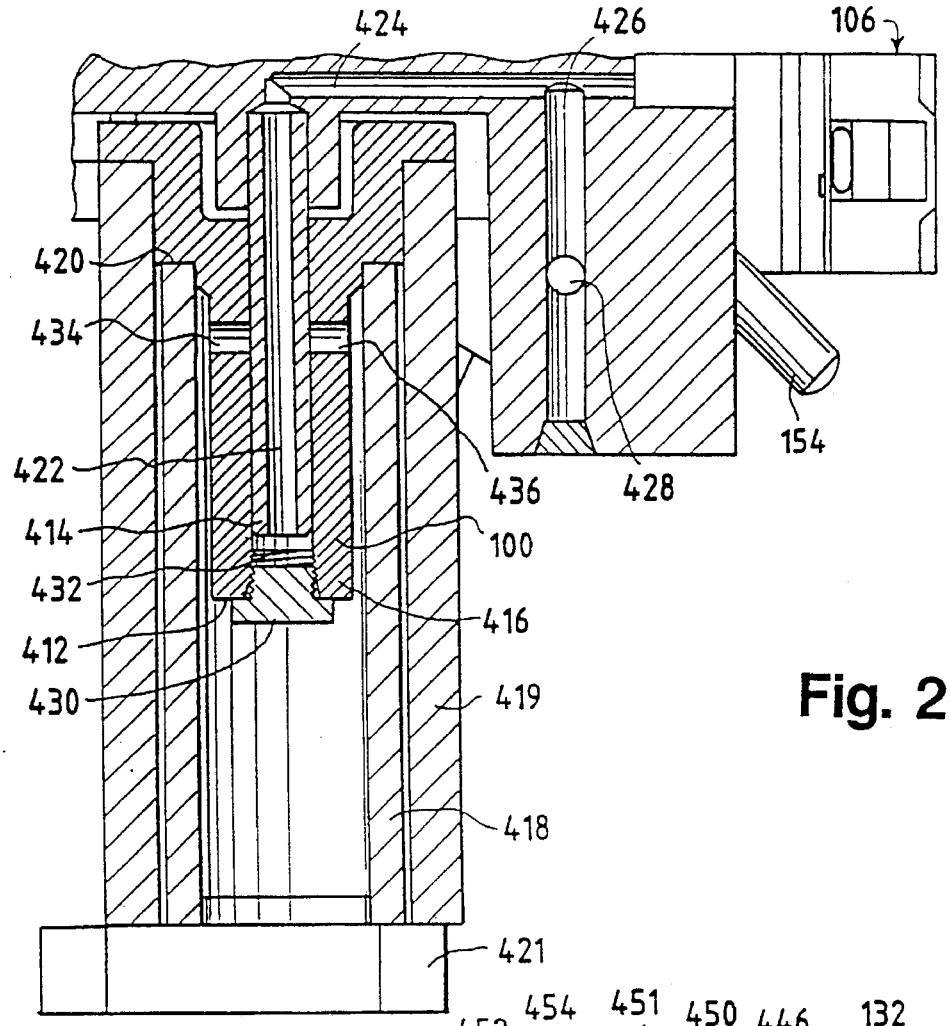
FIG. 26 is a sectional view similar to FIG. 12 illustrating an alternative accumulator according to the present invention.

FIG. 26 illustrates an alternative embodiment of the accumulator 100 which may take the place of the bulk oil modulus accumulator illustrated in FIG. 12. The accumulator of FIG. 26 is of the mechanical type and includes an expandable accumulator chamber 412 including a fixed cylindrical center portion 414 and a movable outer portion 416 which fits closely around the center portion 414 and is concentric therewith. A pair of springs, shown schematically at 418 and 419, are located between and bear against a shouldered portion 420 of the outer portion 416 and a spacer 421 disposed on the engine head and bias the outer portion 416 upwardly as seen in FIG. 26.

The center portion 414 includes a central bore 422 which is in fluid communication via conduits 424, 426 and 428 with the pump unit 88. During operation, the pump unit 88 pressurizes oil which is supplied through the conduits 424–428 to the central bore 422 of the center portion 414. A threaded plug 430 is threaded into a lower portion of the outer portion 416 to provide a seal against escape of oil and hence the pressurized oil collects in a recess 432 just above the threaded plug 430. The pressurized oil forces the outer portion 416 downwardly against the force exerted by the springs 418 and 419 so that the volume of the recess 432 increases. Overfilling of the recess 432 is prevented by vent holes 434, 436 which, as oil is introduced into the recess 432, are eventually uncovered and cause oil in the recess 432 to be vented.

Figure 27:
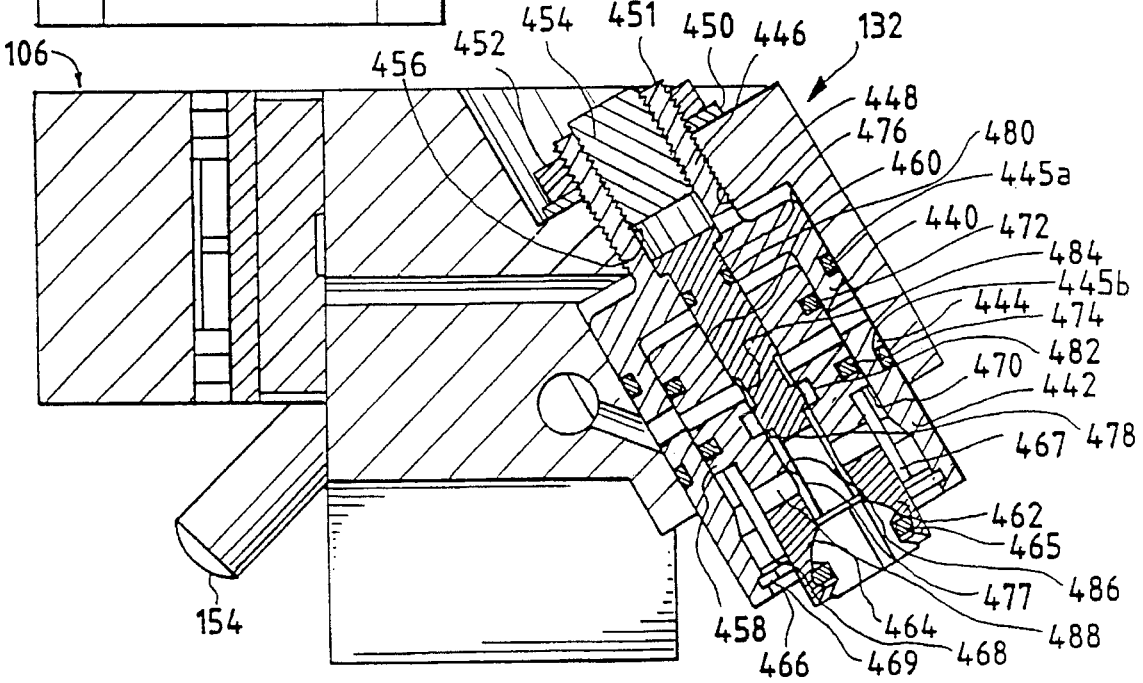
FIGS. 27–29 are sectional views similar to FIG. 17 illustrating alternative actuators according to the present invention.

Referring to FIG. 27, there is illustrated an actuator 440 which may be used in place of the actuator 110 or 112 illustrated in FIG. 5. The actuator 440 includes an outer sleeve 442 which is slip-fit into a bore 444 in the main body 132 at an adjustable axial position and is sealed by the upper and lower O-rings 445*a*, 445*b*. If desired, a close fit may be provided between the outer sleeve 442 and the bore 444, in which case the O-rings 445*a*, 445*b* may be omitted. An upper portion 446 is threaded into a bore 448 in the main body 132 and a washer 450 is placed over a threaded end 451. A nut 452 is threaded over the threaded end 451 and assists in maintaining the actuator 440 within the main body 132 at the desired axial position. A threaded plug 454 is received within a threaded bore 456 at an adjustable axial position within the upper portion 446.

Disposed within the outer sleeve 442 is a slave fluid control device in the form of a piston 458 having a central bore 460 therethrough and an extended lower portion 462 that carries a socketed swivel foot 464 which is retained within a hollow end of the lower portion 462 by an O-ring retainer 465. The swivel foot 464 is adapted to engage an exhaust valve rocker arm (not shown in FIG. 27). The lower portion 462 extends beyond an open end 466 of the outer sleeve 442. A spring, illustrated schematically at 467, is placed in compression between a washer 468 and retaining ring 469 and a shoulder 470 of the piston 458. First and second sliding seals 472, 474 provide sealing between the piston 458 and the outer sleeve 442. If desired, the seals 472, 474 may be omitted if a tight sliding fit is provided between the piston 458 and the outer sleeve 442.

A master fluid control device in the form of a valve spool 476 is disposed within the central bore 460. A spring 477 is disposed between the swivel foot 464 and a shoulder 478 of the valve spool 476 and biases the valve spool 476 upwardly. A further sliding seal 480 is disposed between the valve spool 476 and the outer sleeve 442.

The operation of the actuator 440 is identical to the actuator 110 or 112 described above in the way that the piston 458 and the valve spool 476 interact to control the lift and regulate the force provided by the piston 458. The piston 458 has angled bores (not seen in the section of FIG. 27) and an annular groove 482 which moves into and out of engagement with a high pressure annulus 484 and a low pressure volume 486 which is connected by a passage 488 to sump to provide all of the functions previously described in the preferred embodiment, with the exception that oil flows freely out of the open end 466 of the outer sleeve 442 rather than being returned to the pump inlet.

The amount of travel of the spool 476 is determined by the axial position of the plug 454 in the threaded bore 456. In addition, the lash or space between the swivel foot 464 and the exhaust rocker arm can be adjusted by adjusting the axial position of the upper portion 446 of the actuator 440 in the threaded bore 448. The nut 452 may then be tightened to prevent further axial displacement of the actuator 440.

Figure 28:
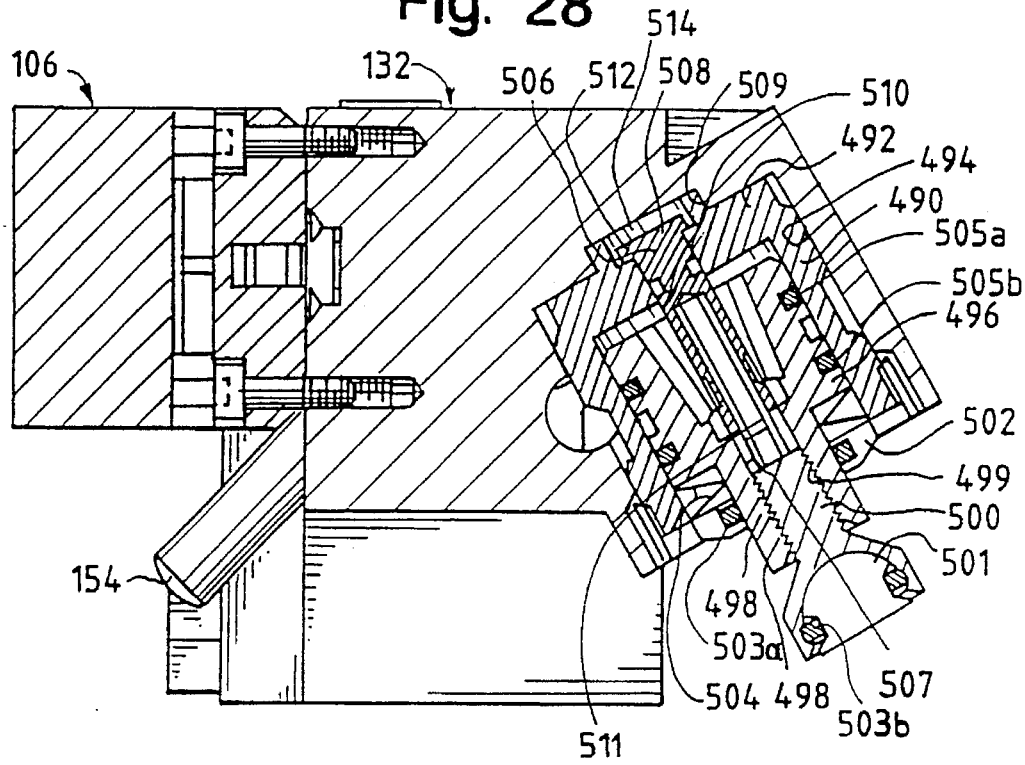

Referring now to FIG. 28, there is illustrated a further actuator 490 according to the present invention. The actuator 490 is similar to the actuator 440 and operates in the same fashion, and hence only the differences between the two will be discussed in detail herein.

The actuator 490 includes an actuator body 492 which is tightly slip-fitted within a bore 494 of the main body 132. A slave fluid control device in the form of a piston 496 includes an extended lower portion 498 having a threaded bore 499. A cylindrical member 500 is threaded into the threaded bore 499 at an adjustable position and is retained at such position by any suitable means, such as a nylon patch or a known locking compound. The cylindrical member 500 includes a socketed swivel foot 501 which is retained within a hollow end of the cylindrical member 500 by a retaining O-ring 503*a* and which is similar to the swivel foot 464 in that the foot 501 is capable of engaging a rocker arm which is in turn coupled to exhaust valves of a cylinder. The lower portion 498 extends through an end cap 502 threaded into the bore 494 and an O-ring 503*b* prevents leakage of oil between the end cap 502 and the lower portion 498. A set of belleville springs 504 or, alternatively, a wave spring, is placed in compression between the piston 496 and the end cap 502. The cap 502 further holds the actuator body 492 against an upper surface of the bore 494.

In addition, a pair of optional sliding seals 505*a*, 505*b* may be provided between the piston 496 and the actuator body 492, if necessary or desirable, or close fit machined surfaces of the piston 496 and the 492 may be provided, in which case the seals 505*a*, 505*b* would not be necessary.

A master fluid control device in the form of a valve spool 506 is closely received within a central bore 507 of the piston 496. The valve spool 506 includes an enlarged head 508 disposed within a shouldered recess 509 in the main body 492. A sliding seal 510 is disposed between the valve spool 506 and the actuator body 492 and a spring 511 is placed in compression between the cylindrical member 500 and the valve spool 506.

Although not shown, a passage extends between the space containing the belleville springs 504 to the pump inlet 160 of FIG. 9.

As in the previous embodiments, the piston 496 and the valve spool 506 include the passages and annular grooves which cause the actuator 490 to operate in the fashion described above.

The gap between an upper face 512 of the enlarged head 508 and a further face 514 formed in the main body 132 determines the amount of lift of the valve spool 506. The lash adjustment is effected by threading the cylindrical portion 500 into the threaded bore 499 to a desired position.

Figure 29:
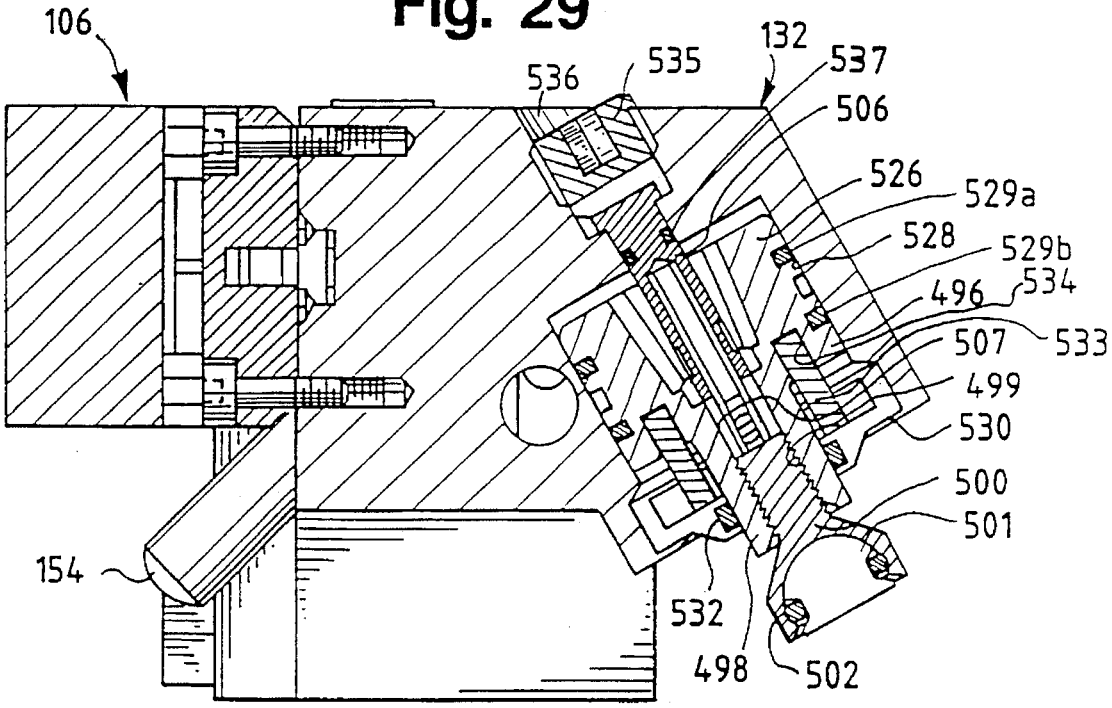

FIG. 29 illustrates yet another actuator 526 according to the present invention wherein elements common to FIGS. 28 and 29 are assigned like reference numerals. As in the embodiment of FIG. 28, a piston 496 includes a central bore 507 which receives a valve spool 506. Also, a cylindrical member 500 is threaded into an extended lower portion 498 of the piston 496 at an adjustable position and a socketed swivel foot 501 is carried on the end of the cylindrical portion 500. However, unlike the embodiment of FIG. 28, the piston 496 is received directly within a bore 528 in the main body 132 without the use of the actuator body 492. Optional sliding seals 529*a*, 529*b*, similar to the seals 505*a*, 505*b*, respectively, may be provided to seal between the piston 496 and the bore 528. A threaded end cap 530 is threaded into the bore 528 and carries an O-ring 532 which prevents leakage of oil therepast. A coil-type spring 533 is substituted for the belleville springs 504 and is placed in compression between the end cap 530 and a recess 534 in the piston 496.

A threaded plug 535 is threaded into a threaded bore 536 in the main body 132 at an adjustable position to provide an adjustable amount of lift of the valve spool 506. A sliding seal 537, similar to the seal 510, provides a seal between the valve spool 506 and the bore 528.

The embodiment of FIG. 29 is otherwise identical to the embodiment of FIG. 28 and operates in the same fashion.

Figure 30:
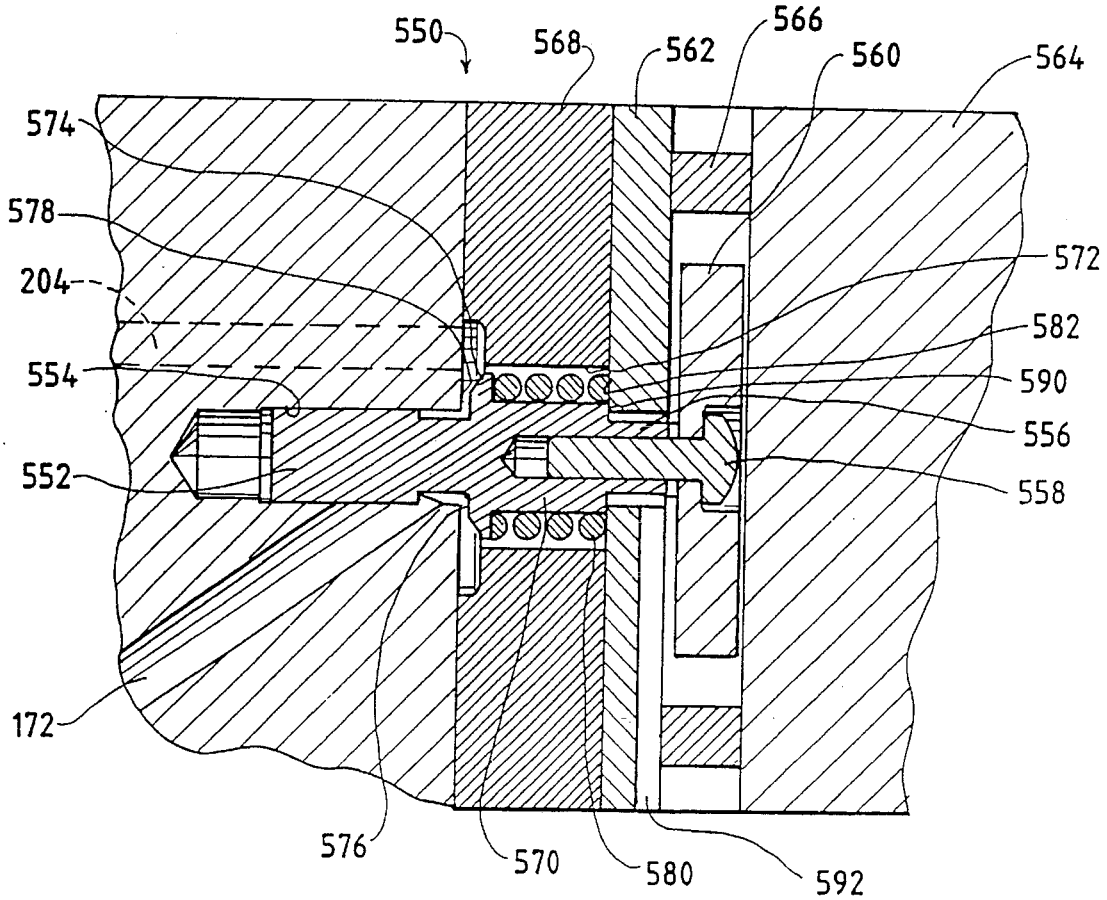
FIG. 30 is a view similar to FIG. 16 illustrating a poppet valve which may be substituted for the valve of FIGS. 15–19 according to an alternative embodiment of the present invention.

In addition to the foregoing alternatives, it should be noted that the ball valve 176 illustrated in FIGS. 15 and 16 may be replaced by any other suitable type of valve. For example, as seen in FIG. 30, a popper valve 550 may be substituted for the ball valve 176. As in the ball valve 176 of FIGS. 15–19, the poppet valve 550 controls the passage of pressurized oil between the passage 172 and the passage 204. The popper valve includes a valve member 552 which is disposed within and guided by a valve bore 554. The valve member 552 further includes a head 556 which is threaded to accept the threads of a screw 558 identical to the screw 186 of FIGS. 15–19. As in the previous embodiment, the screw 558 includes a head which is received within an armature 560.

A rear stop 562 is spaced from a solenoid winding, illustrated schematically at 564, by an armature spacer 566 and is located adjacent a popper spacer 568. The valve member 552 further includes an intermediate portion 570 which is disposed within a stepped recess 572 in the poppet spacer 568. The intermediate portion 570 includes a circumferential flange 574 having a sealing surface 576 which is biased into engagement with a sealing seat 578 by a spring 580 placed in compression between the flange 574 and a face 582 of the rear stop 562.

The popper valve 550 is shown in the on or energized condition wherein the armature 560 is pulled toward the solenoid winding 564 owing to the current flowing therein. This displacement of the armature 560 causes the valve member 552 to be similarly displaced, thereby causing the sealing surface 576 to be spaced from the sealing seat 578. This spacing permits fluid communication between the passages 172 and 204. In addition, a shoulder 590 of the intermediate portion 570 is forced against the face 582 of the rear stop to prevent fluid communication between the passages 172 and 204 on the one hand and a drain passage 592 on the other hand.

When current flow to the solenoid winding 564 is terminated, the spring 580 urges the valve member 552 to the left as seen in FIG. 30 so that the sealing surface 576 is forced against the sealing seat 578, thereby preventing fluid communication between the passages 172 and 204. In addition, the shoulder 590 is spaced from the face 582 of the rear stop 562, thereby permitting fluid communication between the passage 204 and the drain passage 592.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. An engine brake system for opening an engine exhaust valve, comprising:

an actuator including a slave piston having a longitudinal bore therethrough and a further bore extending from the longitudinal bore to a recess on one side of the slave piston, a valve spool disposed in the bore and having a high pressure annulus and a low pressure annulus spaced from the high pressure annulus wherein the valve spool is movable relative to the slave piston to cause the further bore to be placed in fluid communication with the high pressure annulus or the low pressure annulus, the actuator further including a high pressure inlet coupled to the high pressure annulus and a low pressure outlet coupled to the low pressure annulus; and a pump having a pump inlet coupled to the low pressure outlet and a pump outlet coupled to the high pressure inlet to form a closed-loop system with the actuator.

2. The engine brake system of claim 1, wherein the actuator further includes a further recess on another side of the piston in fluid communication with the low pressure outlet.

3. The engine brake system of claim 1, wherein the actuator further includes a control valve coupled between the pump outlet and an end of the valve spool.

4. The engine brake system of claim 3, wherein the control valve is operable by a solenoid.

5. The engine brake system of claim 1, wherein the actuator includes a first spring on the one side of the slave piston and a second spring on another side of the slave piston.

6. The engine brake system of claim 1, wherein the pump includes a pump piston driven by an engine rocker arm.

7. The engine brake system of claim 1, wherein the actuator and the pump are disposed in a single member.

8. The engine brake system of claim 1, wherein the pump outlet is coupled to the high pressure inlet by a high pressure manifold.

9. The engine brake system of claim 1, further including first and second check valves interconnecting the actuator and the pump.

10. An engine brake system for opening an engine exhaust valve, comprising:

an actuator including a slave piston disposed in an actuator receiving bore, a valve spool disposed in a central bore of the slave piston and means for resiliently interconnecting the valve spool and the slave piston, the valve spool having a high pressure annulus and a low pressure annulus and the slave piston having a passage which is positionable by relative movement between the valve spool and the slave piston into fluid communication with either the high pressure annulus or the low pressure annulus, the actuator further including a solenoid-operated control valve having a high pressure inlet, a low pressure inlet coupled to sump and an outlet in fluid communication with the valve spool and wherein the actuator further includes a high pressure manifold in fluid communication with the high pressure annulus and coupled to the high pressure inlet of the control valve and an actuator outlet in fluid communication with the low pressure annulus; and a pump driven by a fuel injector rocker arm and having a pump inlet coupled to the actuator outlet and a pump outlet coupled to the high pressure manifold.

11. The engine brake system of claim 10, wherein the actuator includes a first spring on the one side of the slave piston and a second spring on another side of the slave piston.

12. The engine brake system of claim 11, wherein the pump includes a pump piston driven by the fuel injector rocker arm.

13. The engine brake system of claim 12, wherein the actuator and the pump are disposed in a single member.

14. The engine brake system of claim 10, further including first and second check valves interconnecting the actuator and the pump.

15. A method of opening an engine exhaust valve using an actuator and a pump wherein the actuator includes a high pressure inlet, a low pressure outlet, a control valve coupled between the high pressure inlet and an actuator receiving bore, a slave piston disposed in the actuator receiving bore and a valve spool disposed in a central bore in the slave piston wherein the valve spool includes a high pressure passage coupled to the high pressure inlet and a low pressure passage coupled to the low pressure outlet and the slave piston includes a slave piston passage having a first end in fluid communication with one side of the slave piston and a second end positionable in response to relative movement of the slave piston and the valve spool into fluid communication with the high pressure passage or the low pressure passage and wherein the pump includes a pump inlet and a pump outlet coupled to the high pressure inlet of the actuator, the method comprising the steps of:

interconnecting the low pressure outlet of the actuator with the pump inlet;

operating the pump to provide high pressure fluid to the high pressure inlet of the actuator; and operating the control valve to pass high pressure fluid from the high pressure inlet of the actuator into the actuator receiving bore so that the valve spool and slave piston are displaced and open the exhaust valve and so that fluid is expelled from the actuator low pressure outlet and is delivered to the pump inlet.

16. The method of claim 15, wherein the control valve includes a solenoid winding and an armature and wherein the step of operating the control valve includes the step of energizing the solenoid winding to move the armature.

17. The method of claim 16, wherein the control valve includes a control valve low pressure inlet coupled to sump and including the further step of deenergizing the solenoid winding subsequent to energizing of the solenoid winding so that fluid is passed from the actuator receiving bore to sump and the valve spool and the slave piston are retracted and the exhaust valve is closed.

18. The method of claim 15, wherein the pump includes a pump piston and wherein the step of operating the pump includes the step of reciprocating the pump piston.

19. The method of claim 18, wherein the step of reciprocating includes the step of causing a fuel injector rocker arm to engage the pump piston.

* * * * *